US006959669B2

(12) United States Patent
Thoma

(10) Patent No.: US 6,959,669 B2
(45) Date of Patent: Nov. 1, 2005

(54) APPARATUS FOR HEATING FLUIDS

(76) Inventor: Christian Helmut Thoma, Chalet Abaco, Green Road, St. Clement, Jersey (GB), JE2 6QA ( * ) Notice: Subject to any disclaimer, the term of this patent is extended or adjusted under 35 U.S.C. 154(b) by 73 days.

(21) Appl. No.: 10/725,447

(22) Filed: Dec. 3, 2003

(65) Prior Publication Data

US 2004/0103856 A1 Jun. 3, 2004

Related U.S. Application Data

(63) Continuation-in-part of application No. 10/308,027, filed on Dec. 3, 2002.

(51) Int. Cl.[7] ..... F22B 3/06
(52) U.S. Cl. ..... 122/26; 126/247; 237/12.3 R
(58) Field of Search ..... 122/26; 126/247; 237/12.3 R

(56) References Cited

U.S. PATENT DOCUMENTS

| | | | |
|---|---|---|---|
| 2,090,873 | A | 8/1937 | Lazarus |
| 3,791,349 | A | 2/1974 | Schaefer |
| 4,424,797 | A | 1/1984 | Perkins |
| 5,188,090 | A | 2/1993 | Griggs |
| 5,392,737 | A | 2/1995 | Newman, Sr. et al. |
| 5,552,133 | A | 9/1996 | Lambert et al. |
| 5,913,306 | A | 6/1999 | Moroi et al. |
| 6,129,287 | A | 10/2000 | Hirose et al. |
| 6,386,751 | B1 | 5/2002 | Wootan et al. |
| 6,627,784 | B2 | 9/2003 | Hudson et al. |

FOREIGN PATENT DOCUMENTS

| | | |
|---|---|---|
| DE | 3327137 | 2/1984 |
| GB | 1 217 959 | 1/1971 |
| GB | 2 143 632 | 2/1985 |
| JP | 55102491 A | 8/1980 |
| JP | 60008391 A | 1/1985 |
| JP | 60226594 A | 11/1985 |
| JP | 62213895 A | 9/1987 |
| WO | WO9411096 | 5/1994 |
| WO | WO99/11478 | 3/1999 |

*Primary Examiner*—Gregory Wilson
(74) *Attorney, Agent, or Firm*—Young & Thompson

(57) ABSTRACT

The apparatus has a housing with a main chamber in which a rotor is situated. A drive shaft drives the rotor about a longitudinal axis of rotation. The housing has a fluid inlet and a fluid outlet, the fluid inlet communicating with an inlet region and a fluid outlet communicating with an exit region. The outer surface of the rotor forms one boundary for the fluid heat generating region and is confronted by the inner surface of the main chamber which is the other boundary. At least one of these surfaces is angularly inclined relative to the axis of rotation of the drive shaft and rotor. By bodily shifting the rotor in a direction along the longitudinal axis, an increase or decrease in the distance between the outer and inner surfaces is possible in order to adjust for wear or to change the degree of shear experienced by the passing fluid.

65 Claims, 20 Drawing Sheets

APPARATUS FOR HEATING FLUIDS

REFERENCE TO RELATED APPLICATION

This application is a Continuation-in-Part of application Ser. No. 10/308,027; filed Dec. 3, 2002, the disclosure of which is incorporated in its entirety by the reference hereto.

BACKGROUND OF THE INVENTION

This invention relates generally to the heating of liquids, and specifically to those devices wherein rotating elements are employed to generate heat in the liquid passing through them. Devices of this type can be usefully employed in applications requiring a hot water supply, for instance in the home, or by incorporation within a heating system adapted to heat air in a building residence. Furthermore, a cheap portable steam generation could be useful for domestic applications such as the removal of winter salt from the underside of vehicles, or the cleaning of fungal coated paving stones in place of the more erosive method by high-pressure water jet.

Joule, a wealthy Manchester brewer and English physicist who lived during the $19^{th}$ century, was the first experimenter to show that heat could be produced through mechanical work by churning liquids such as water. Joule's ideas, as well as the work of others such as Lord Kelvin and Mayer of Germany, eventually led to the Principle of the Conservation of Energy. On the basis of this law, that energy can neither be created nor destroyed, numerous machines have been devised since Joule's early work. Of the various configurations that have been tried in the past, types employing rotors or other rotating members are known, one being the Perkins liquid heating apparatus disclosed in U.S. Pat. No. 4,424,797. Perkins employs a rotating cylindrical rotor inside a static housing and where fluid entering at one end of the housing navigates past the annular clearance existing between the rotor and the housing to exit the housing at the opposite end. The fluid is arranged to navigate this annular clearance between the static and non-static fluid boundary guiding surfaces, and Perkins relies principally on the shearing effect in the liquid, causing it to heat up.

A modern day successor to Perkins is shown in U.S. Pat. No. 5,188,090. Like Perkins, the James Griggs machine employs a rotating cylindrical rotor inside a static housing and where fluid entering at one end of the housing navigates past the annular clearance existing between the rotor and the housing to exit the housing at the opposite end. The device of Griggs has been demonstrated to be an effective apparatus for the heating of water and is unusual in that it employs a number of surface irregularities on the cylindrical surface of the rotor. Such surface irregularities on the rotor seem to produce an effect quite different than the forementioned fluid shearing in the Perkins machine, which Griggs calls hydrodynamically induced cavitation.

What is certain is that both Perkins and Griggs choose to employ a fixed gap clearance between the rotating rotor and the static housing. The choice thus made means that once the machine is assembled, the clearance cannot be changed. Although changing the clearance can obviously be achieved through subsequent machine disassembly and substitution of the rotor with one having either a smaller or larger diameter, such an act is both costly and time consuming to perform. Also once such a machine is installed in its intended application environment, it may turn out not to be best suited for the task at hand, and any subsequent rectification at the site of the application is best avoided if at all possible. An expensive option would to manufacture a series of machines, each exhibiting a slight variation in the clearance size. However, a better and more advantageous solution would be include the possibility for changing the clearance without having to disassembly the machine. This could also be easily done at the site of the application.

A further problem could occur in the event of any appreciable wear occurring during the design lifetime of the machine. Scale or other impurities that may on occasion pass through the clearance might cause sufficient damage to the surfaces that as a result, there is a noticeable drop in the efficiency of energy conversion. Were this to occur with such fixed clearance devices, the machine would require disassembly and repair. There would be an advantage however, if the damaged surfaces could be readjusted to reduce the operating clearance, thus saving the expense of performing a costly repair.

There therefore is a need for a new solution to overcome the above mentioned disadvantages, and in particular, there would be an advantage if the solution were simple to implement, resulting in an improved and easily controllable device, and especially whenever possible, without the need for the device to be torn down from the application in order to perform the required alterations/corrections in the event, for instance, a change in the desired operational characteristics of the device be sought for.

SUMMARY OF THE INVENTION

A principal object of the present invention is to provide a novel hot water and steam generator capable of producing heat at a high yield with reference to the energy input.

It is a further object of the invention to use a vector component of the centrifugally induced forces in the liquid towards propelling the liquid through the device, in additional to the impulse on the fluid introduced by the difference in relative velocities of the opposing fluid boundary surfaces. It is therefore a feature of the invention that liquid particles drawn into the annular conduit are not only heated through the shearing action between the opposing fluid boundary surfaces, but are also propelled by such natural forces known in nature to exit the device.

It is a further feature of this invention, as disclosed for certain preferred embodiments, that there be an ability provided whereby the size in the clearance between the rotating and stationary elements can be changed without undue complication. Changing the clearance, squeezing the fluid film in the gap between the static and non-static fluid boundary guiding surfaces, introduces a change in the dynamic behaviour of the fluid as it rushes over these surfaces.

There would also be an advantage in being able to take care of a small amounts of wear affecting the working clearance of the device, simply and cheaply, by resetting the minimum amount of gap height in the clearance. It is therefore a further object of the invention to provide, when required, provision for the adjustment in the annular clearance between rotor and housing. Furthermore, such an adjustment allow each machine to be fined tuned and tailor made to suit each particular application.

It is a further aspect of this invention is to provide an internal fluid heating vessel chamber for the device in which the radial width dimension changes as soon as the axial length dimension is changed. Therefore, in one form of the invention as described, the annular fluid volume between the rotating rotor and the static housing is changed as soon as the rotor is displaced along its longitudinal rotating axis. By thus altering the annular fluid volume, the shear in the passing fluid is changed. Turbulence and frictional effects experienced in the fluid during its passage through the annular fluid volume can thereby be more easily controlled as compared to prior solutions relying on a fixed clearance between the revolving rotor and the static housing. Accordingly, it is a further object of the invention for the device to provide more flexibility for each particular application and dynamic operational condition, regardless whether the heat output is in the form of a liquid or vapour at various pressures.

In one form thereof, the invention is embodied as an apparatus for the heating of a liquid such as water, comprising a housing having a main chamber. A central member is located in the chamber and moveable relative to the housing about an axis of rotation. The central member is provided with an outer surface and the chamber is provided with an inner surface radially spaced apart such that these surfaces confront each other without touching so thereby defining an annular fluid volume between them. A fluid inlet is arranged to communicate with the annular fluid volume nearer one end of the chamber and where a fluid outlet is arranged to communicate with the annular fluid volume nearer the opposite end of the chamber. At least one of these surfaces is to be angularly inclined with respect to the axis of rotation.

Any relative axial movement between these surfaces will result in a change in the annular fluid volume, expanding or contracting, and where preferably, the central member is a rotor having its smaller diametric end nearer the fluid inlet and the larger diametric end nearer the fluid outlet.

According to the invention from another aspect, the smaller diametric end of the rotor can be formed to include an impeller. The action of the rotating impeller on the fluid entering the chamber being to propel it outwardly and where the axial position of the impeller moves along the longitudinal axis of the drive shaft in accordance with the bodily shifting of the rotor assembly. It is therefore a still further aspect of this invention, as disclosed for certain preferred embodiments, to provide a device of the preceding objects in which the intake of fluid from an external source is excited by an internally driven spinner impeller to substantially raise the pressure of fluid entering the annular fluid volume also termed the fluid heat generating region. By thus increasing the positive head of the fluid as it commences entry to the fluid heat generating region, the running efficiency of the device may thereby be improved.

Applications where mains water pressure can be used, or the source tank is situated well above the height of the device thereby providing a positive head at the fluid inlet, the impeller may not be required. However, under normal atmospheric conditions with liquid entering the device from a source having a surface level positioned approximately at the same height elevation as the device, the addition of an internal impeller would better ensure positive priming of the device. In the preferred embodiment used to describe the present invention, such an impeller is shown.

Other and further important objects and advantages will become apparent from the disclosures set out in the following specification and accompanying drawings.

BRIEF DESCRIPTION OF THE DRAWINGS

The above mentioned and other novel features and objects of the invention, and the manner of attaining them, may be performed in various ways and will now be described by way of examples with reference to the accompanying drawings, in which.

These figures and the following detailed description disclose specific embodiments of the invention; however, it is to be understood that the inventive concept is not limited thereto since it may be incorporated in other forms.

DETAILED DESCRIPTION OF THE FIRST ILLUSTRATIVE EMBODIMENT OF THE INVENTION

Figure 1:
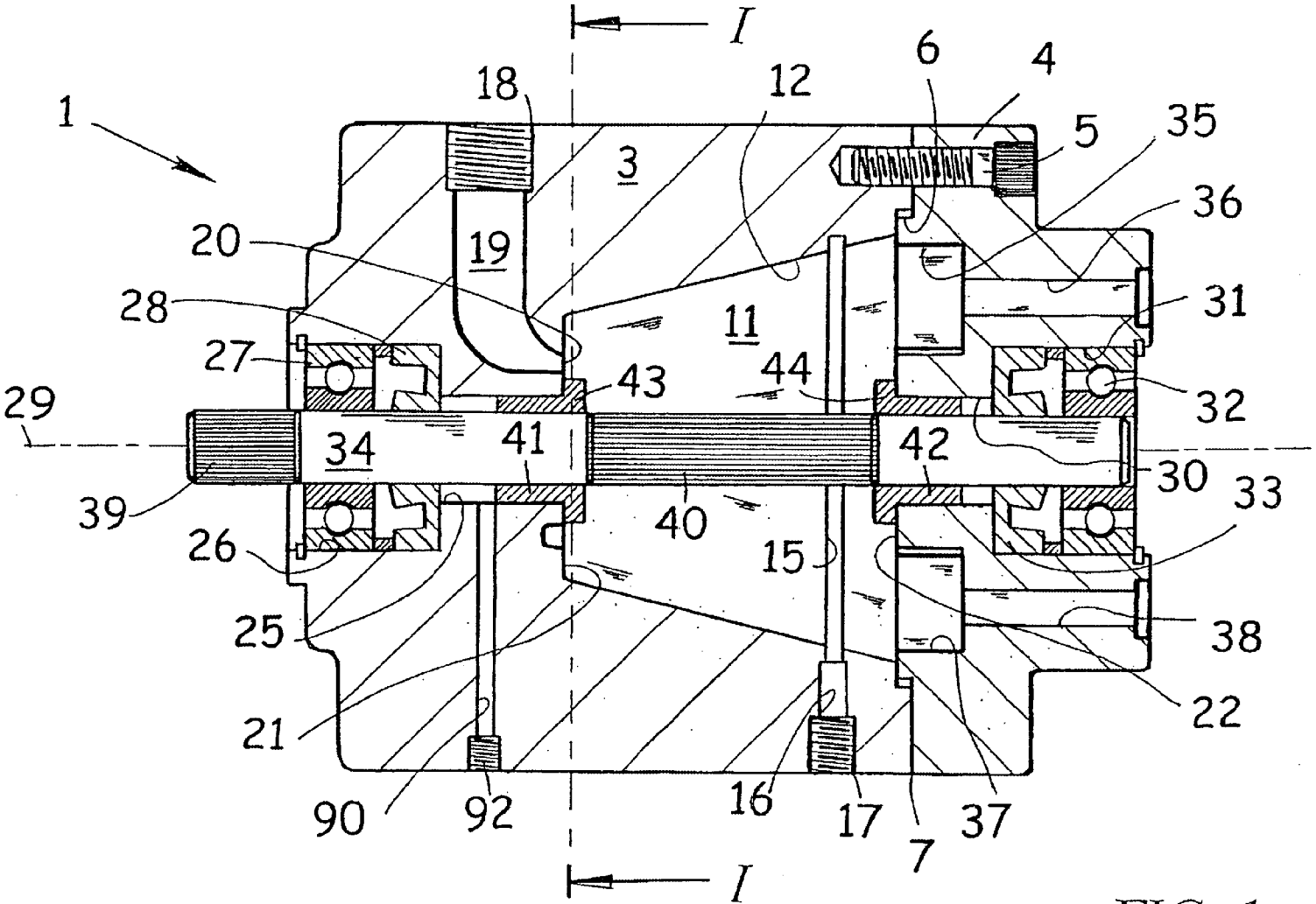
FIG. 1 is a longitudinal sectional view of a device according to the first embodiment of the present invention, with the rotor assembly missing.

Referring to FIG. 1, the device as embodiment by reference numeral 1 has a housing structure comprising two elements 3, 4 joined together along a parting plane denoted by numeral 7. A number of fastening screws 5 is used to hold housing elements 3, 4 together and alignment is achieved through radial register 6. To simplify description of the device, it will be noted by comparing FIG. 1 with FIGS. 3 and 4, that the central member, it being the rotor assembly 10, has purposely omitted from FIG. 1 but shown in its extreme right and left hand positions in FIGS. 3 and 4, respectively.

As the device 1 relies on having a rotor assembly to function, FIG. 1 is purely intending to portray the shape of main chamber depicted by numeral 11 in FIG. 1. Housing element 3 is provided with a conical inner surface 12 having its greater diameter nearer the registered end 6 and the smaller diameter in the interior of housing element 3. Included on the conical inner surface 12 is circumferential liquid capturing groove 15, and groove 15 is connected by radial passageway 16 to the fluid outlet 17 of the device 1. In the example shown, capturing groove and radial passageway (leading to the fluid outlet 17) collectively form the exit region. Fluid outlet 17 allows the exhausted liquid or gas to exit the heating apparatus once it has been heated due the action of the rotating rotor in concert with the stationary housing.

Figure 2:
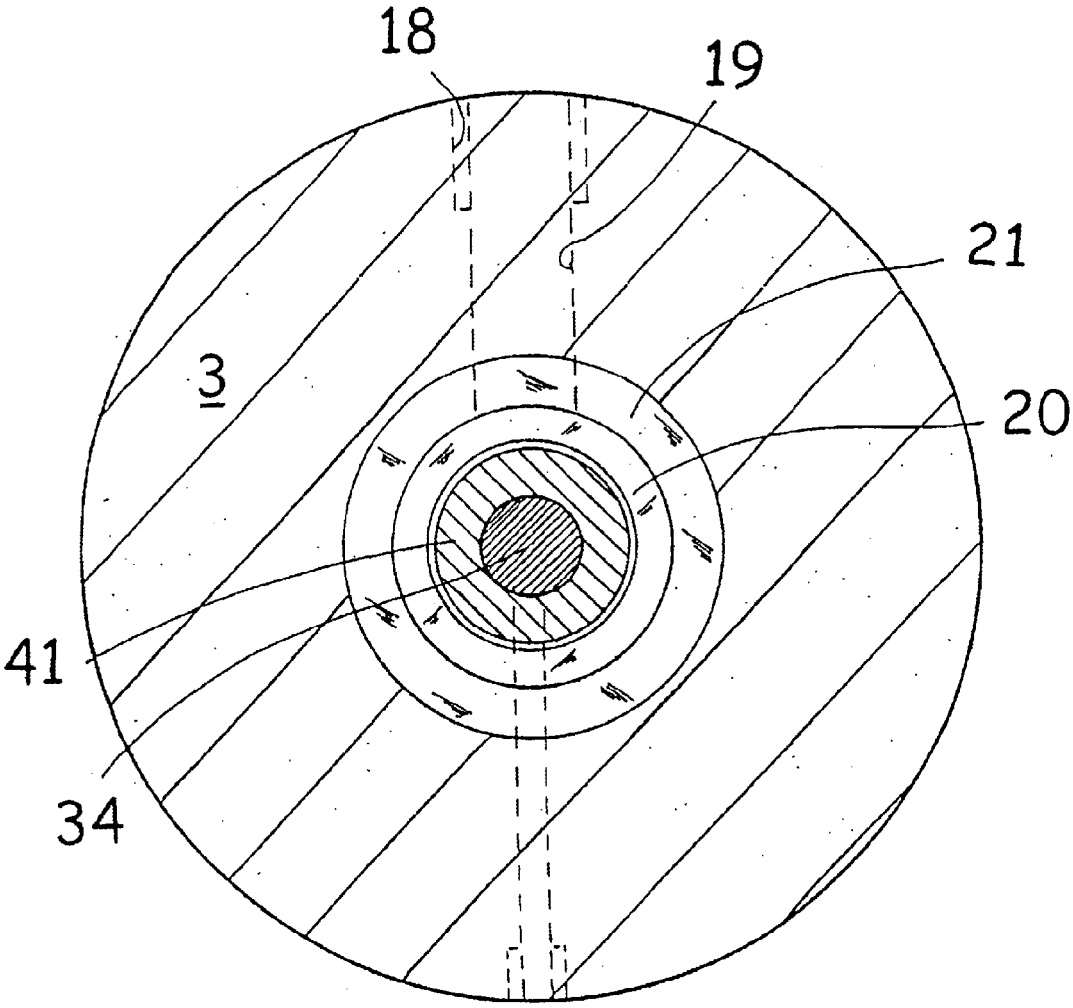
FIG. 2 is a transverse sectional view of the device taken along line I—I in FIG. 1.

Fluid inlet 18, for allowing fluid from an external source to enter the heating apparatus 1, is provided in housing element 3 and where passageway 19 connects fluid inlet 18 with main chamber 11 via port 20. Port 20 is formed on interior vertical face 21 in housing element 3, and as shown in FIG. 2, port 20 is preferably circular in shape. The portion of main chamber 11 lying between vertical face 21 and left hand end face of the rotor assembly 10, that connects with passageway 19 via port 20 forms the inlet region. At the center of vertical face 21, axial hole 25 is provided and which is stepped at 26 in order to accept bearing 27 and seal 28. A similar sized axial hole 30 is provided in housing element 4, and is likewise stepped at 31 in order to accept bearing 32 and seal 33. Hole 30 is arranged to lie at the center of vertical face 34. The bearings 27, 32 provide support for the drive shaft 34. The drive shaft 34 once located in the housing structure of the device protrudes out from one side of the housing to be connected to an external drive source such as an electric motor. Although by no means essential, it can nevertheless be desirable for the drive shaft to be driven by a constant speed electric motor. The drive shaft 34, rotatably supported in housing element 3 by bearing 27, extends into main chamber 11 and is rotatably supported in housing element 4 by bearing 32. The action of seals 28, 33 protects bearings 27, 32 from the liquid in main chamber 11. The bearings 27, 32 preferably are provided with an integral dust seals on their outboard sides to protect against environmental contamination.

Figure 3:
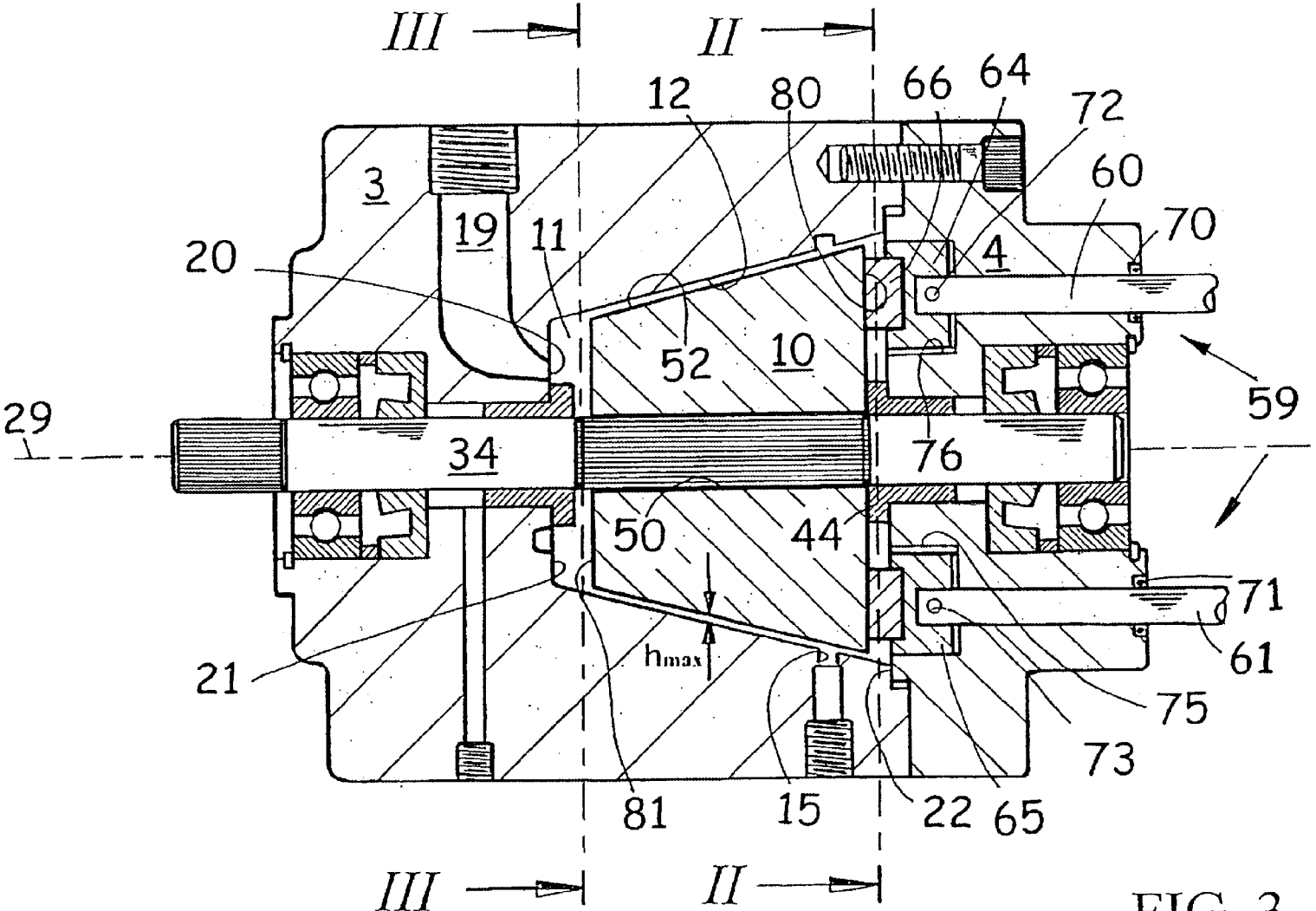
FIG. 3 is a longitudinal sectional view of a device according to the present invention with the internally disposed rotor assembly shown in the extreme right position corresponding to the maximum annular fluid volume.

Housing element 4 also includes a pair of stepped bores 35, 36 and 37, 38 respectively, as shown in FIG. 1, the respective longitudinal axes of which lies parallel to the rotating axis 29 of the drive shaft 34. In FIG. 3 it is shown how such bores relate with rotor assembly displacer 59.

The externally protruding end 39 of drive shaft 34 is shown formed with drive splines although other forms of drive connections can alternatively be used such as a keyway. Preferably, similar splines 40 are provided along that portion of the drive shaft 34 that spans internal chamber 11. A pair of sleeves 41, 42 are provided to each side of the splines portion 40 of drive shaft 34, sleeve 41 being located in hole 25 in housing element 3 with its flanged end 43 residing slightly proud of vertical face 21. Similarly, the flanged end 44 of sleeve 42 resides slightly proud of vertical face 22 of housing element 4 whereas the remaining portion engages with hole 30.

In FIG. 3, the rotor assembly 10, being the central member for the device 1, is shown located in main chamber 11. Rotor assembly 10 is provided with a central longitudinal splined hole 50, which engages splines 40 of drive shaft 34. Thereby rotor assembly 10 and drive shaft 34 can rotate at equal speed while the splined connection 40, 50 allows the rotor assembly 10 to be displaced axially along the longitudinal axis of drive shaft 34 to an extent governed by the flanged ends 43, 44 of respective sleeves 41, 42. Essentially flanged end 43 limits the potential axial movement of the rotor assembly 10 in the left hand direction towards vertical face 21 of main chamber 11 whereas flanged end 44 limits the potential axial movement in the right hand direction towards vertical face 22. FIG. 3 shows the rotor assembly 10 in its extreme right hand position, ie. adjacent to flanged end 44 of sleeve 42.

Figure 4:
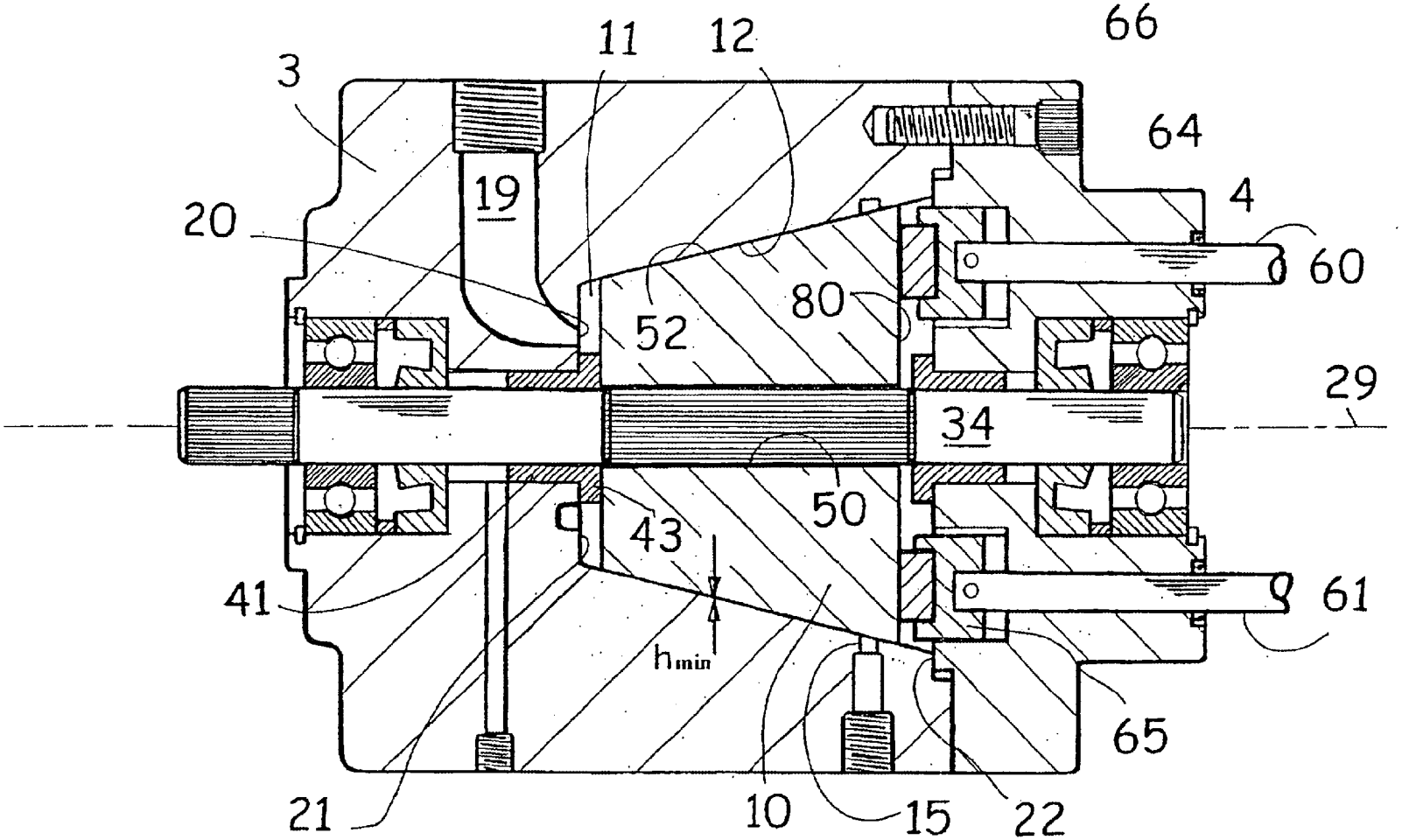
FIG. 4 is a longitudinal sectional view of a device according to the present invention with the internally disposed rotor assembly shown in the extreme left position corresponding to the minimum value annular fluid volume.

Rotor assembly 10 is provided with an outer surface 52 which is arranged disposed parallel to the inner surface 12 in chamber 11. In this embodiment, both surfaces 12, 52 are angularly inclined with respect to the rotating axis of the rotor by the same amount. As such, surface 52 on the rotor 10 and the inner surface 12 of the housing 3 face each other with a predetermined radial distance shown as $h_{max}$ in FIG. 3. Thus these first and second surfaces, being circumferentially spaced apart, serve as slightly separated confining walls for directing the passing fluid. The radial distance $h_{max}$ between surfaces 12, 52 is indicative of the maximum annular clearance allowable, annular clearance also being referred to in the claims as the annular fluid volume in the fluid heat generating region, that can occur between the rotating element, namely the rotor assembly 10, and the static element, namely the housing 3. By contrast, FIG. 4 indicates the minimum annular clearance, shown as $h_{min}$, that can occur between these surfaces which although as depicted, the surfaces seem to engage, in practice a very small radial gap would be essential in order to prevent the rotor assembly 10 actually seizing in the housing 3. FIG. 4 therefore shows the rotor assembly 10 in its extreme left hand position, ie. adjacent to flanged end 43 of sleeve 41, and this being the minimum annular fluid volume condition set for the device 1.

All embodiments of the present invention are shown utilizing the same form of rotor assembly displacer 59, this comprising a pair of rods 60, 61 that act through shoes 64, 65, respectively, and carbon faced seal ring 66 to bodily move rotor assembly 10 in a direction towards vertical wall 21. Should surfaces 12, 52 become worn during service, the facility of the displacer 59 allowing the adjustment of the rotor position relative to the static housing means that there is less chance of such wear being such a problem as in prior machines. Accordingly, with the machine of the present invention, there is now no need to disassemble the machine as now, the annular clearance between the first and second operational surfaces 12, 52 can be reduced by moving rotor 10 axially to be closer to the housing 3.

Although not shown, retraction means can be included, if required, in order to body shift rotor 10 assembly in a direction back towards vertical wall 22. However, as here illustrated, the rotor assembly 10 is biased towards vertical wall 22 by the operational action of the device as well as the agitated state of the liquid during operation on entering main chamber 11 from circular port 20.

Rod 60 is a sliding fit in bore 36 and operates through a seal 70 provided in housing element 4 to engage shoes 64.

A cross pin 72 is used to lock rod 60 to shoe 64 and shoe 64 is a sliding fit in bore 35. Similarly, rod 61 is a sliding fit in bore 38 and operates through seal 71 to engage with shoe 65, shoe 65 and rod 61 being retained together by cross pin 73. An axial groove 75 in provided in bore 37 in order to equalize pressure between respective end faces of shoe 65 and a similar axial groove 76 is shown for bore 35.

Figure 5:
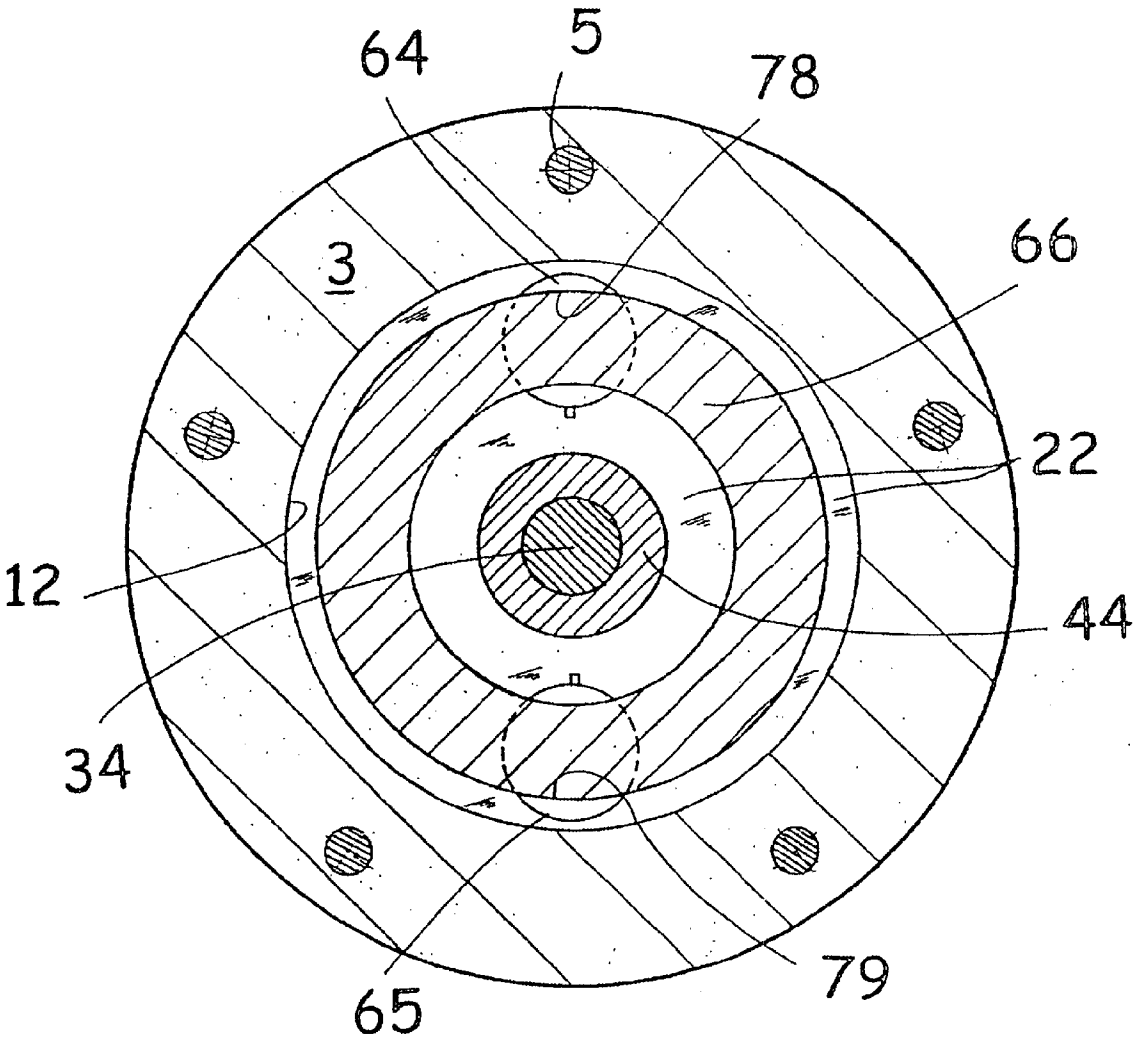
FIG. 5 is a transverse sectional view of the device taken along line II—II in FIG. 3.

Carbon faced seal ring 66 has the shape of a circular disc as shown in FIG. 5 and is arranged to held in slots 78, 79 in shoes 64, 65 respectively. Carbon faced seal ring 66 operates against the surface face 80 of the larger diameter distal end of rotor assembly 10. Numerals 80, 81 thereby are also indicative of the respective distal ends of the rotor assembly 10.

Figure 6:
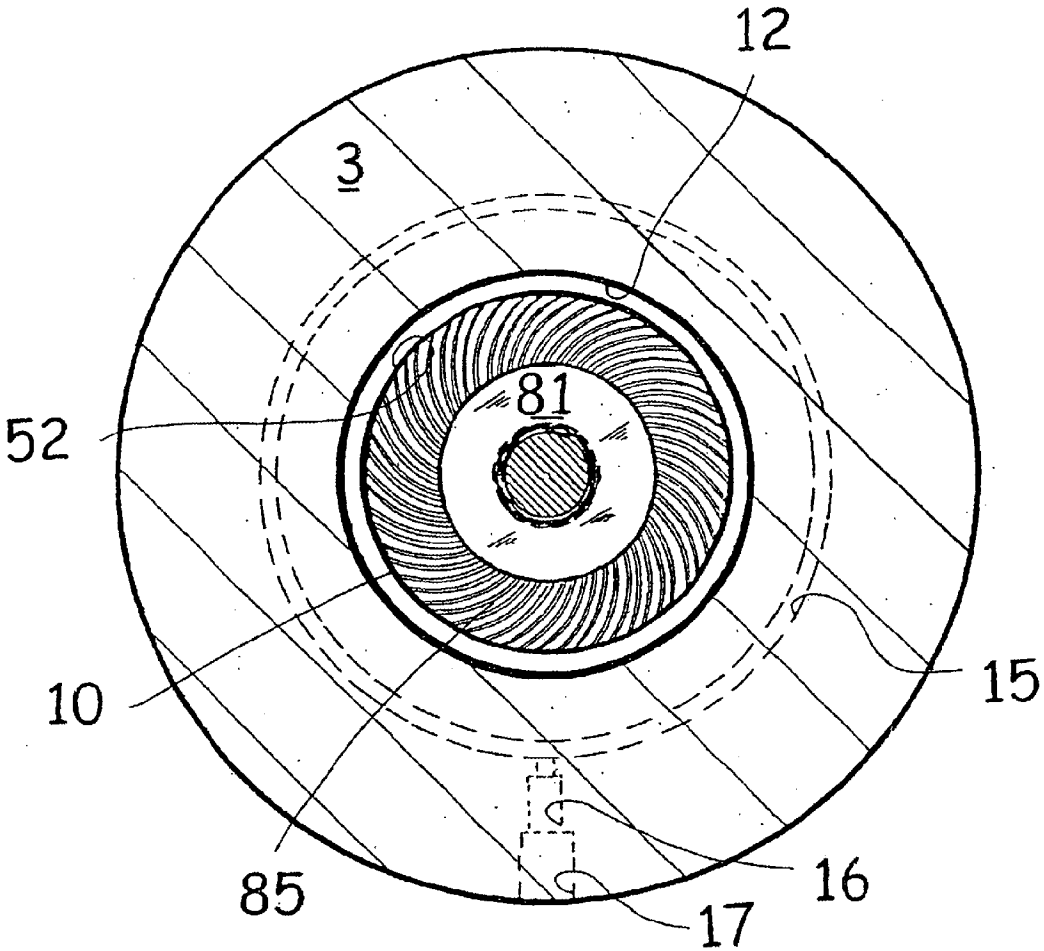
FIG. 6 is a transverse sectional view of the device taken along line III—III in FIG. 3.

The opposing surface face 81 of rotor assembly 10, as shown in FIG. 6, preferably is formed to include a spinner impeller 85 over a portion of its available end surface, comprising a plurality of curved vanes. Rotating of the rotor assembly 10 in anti-clockwise direction has an immediate effect on the liquid entering through port 20 into inlet region 11 as the curves vanes serve to impel the liquid radially outwardly towards the inner surface 12 of housing element 3.

Though a combination of such agitation caused by the curved vanes as well as any positive head on the liquid as it enters the device 1 at fluid inlet 18, acting together with a suction action on the liquid, generated by the axially expanding annular clearance along the length of the rotor assembly 10 between the rotating surface 52 of the rotor assembly and the static surface 12 of the housing element 3, causes the liquid to travels in a direction towards circumferential groove 15. The repeated shearing action on the liquid based on the relative velocity between the stationary and the moving surfaces, as it travels through the annular fluid volume towards circumferential groove 15, heats up the liquid. Unlike known machines using rotating rotors, in the present invention the shearing of the fluid takes place in an ever-increasing volumetric chamber over the substantive axial length of the rotor. The heated liquid in fluid heat generating region on entering circumferential groove 15 and radial hole 16 of the exit region departs from the device 1 as liquid or vapour at fluid outlet 17.

Liquid not expelled from the device but having reached the space between face 80 and vertical wall 22, is allowed to drain from the unit 1 by seeping past carbon faced seal ring 66 and sleeve 42 to reach shaft 34 from where it can travel along splines 40 and sleeve 41 to reach hole 25 and radial drilling 90 and drain connection 92.

DETAILED DESCRIPTION OF THE SECOND EMBODIMENT OF THE INVENTION

Figure 7:
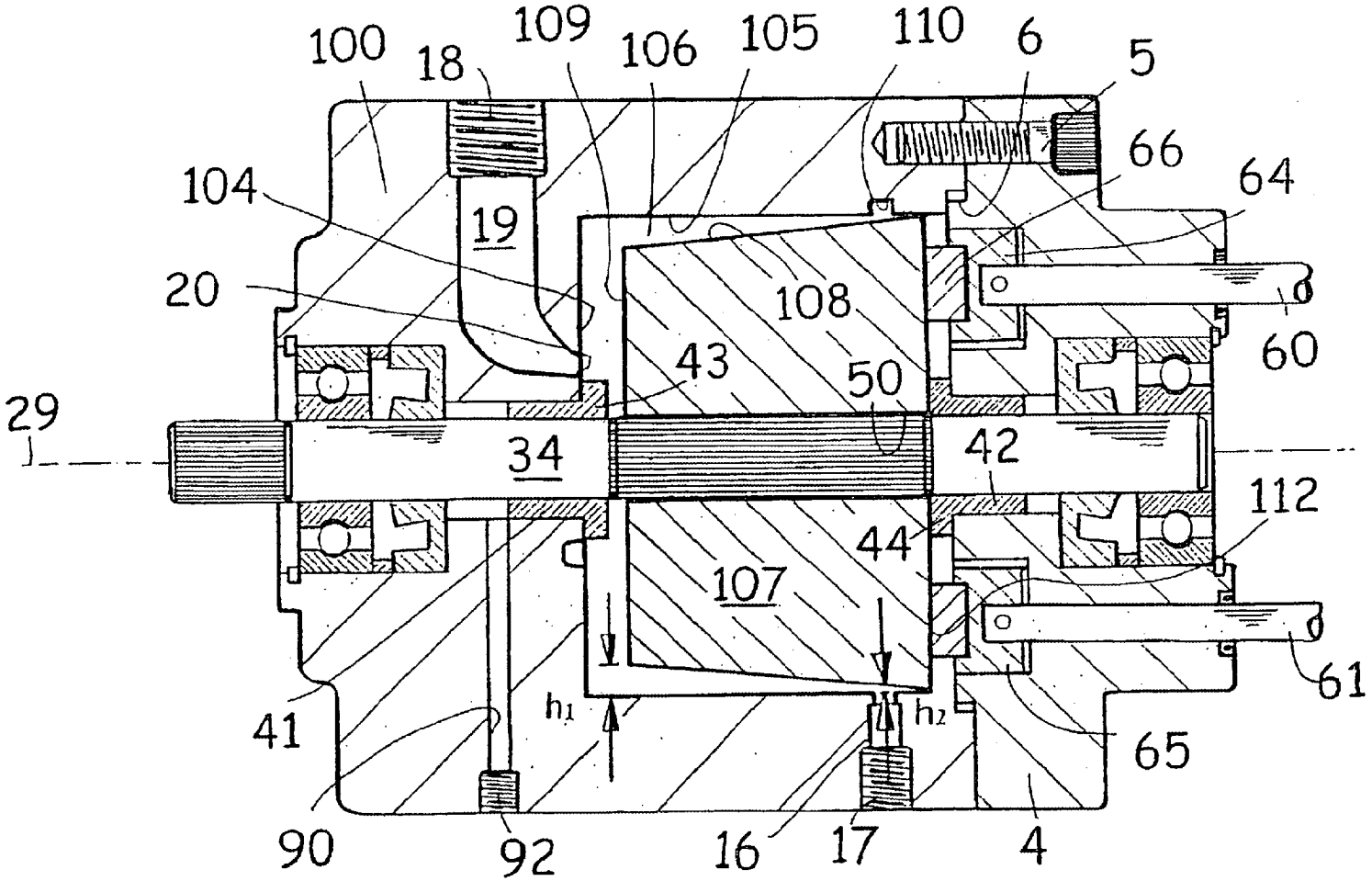
FIG. 7 is a longitudinal sectional view of a device according to the second embodiment of the present invention, with the internally disposed rotor assembly shown in the extreme right position corresponding to a maximum value for radial clearance at the capturing groove.
Figure 8:
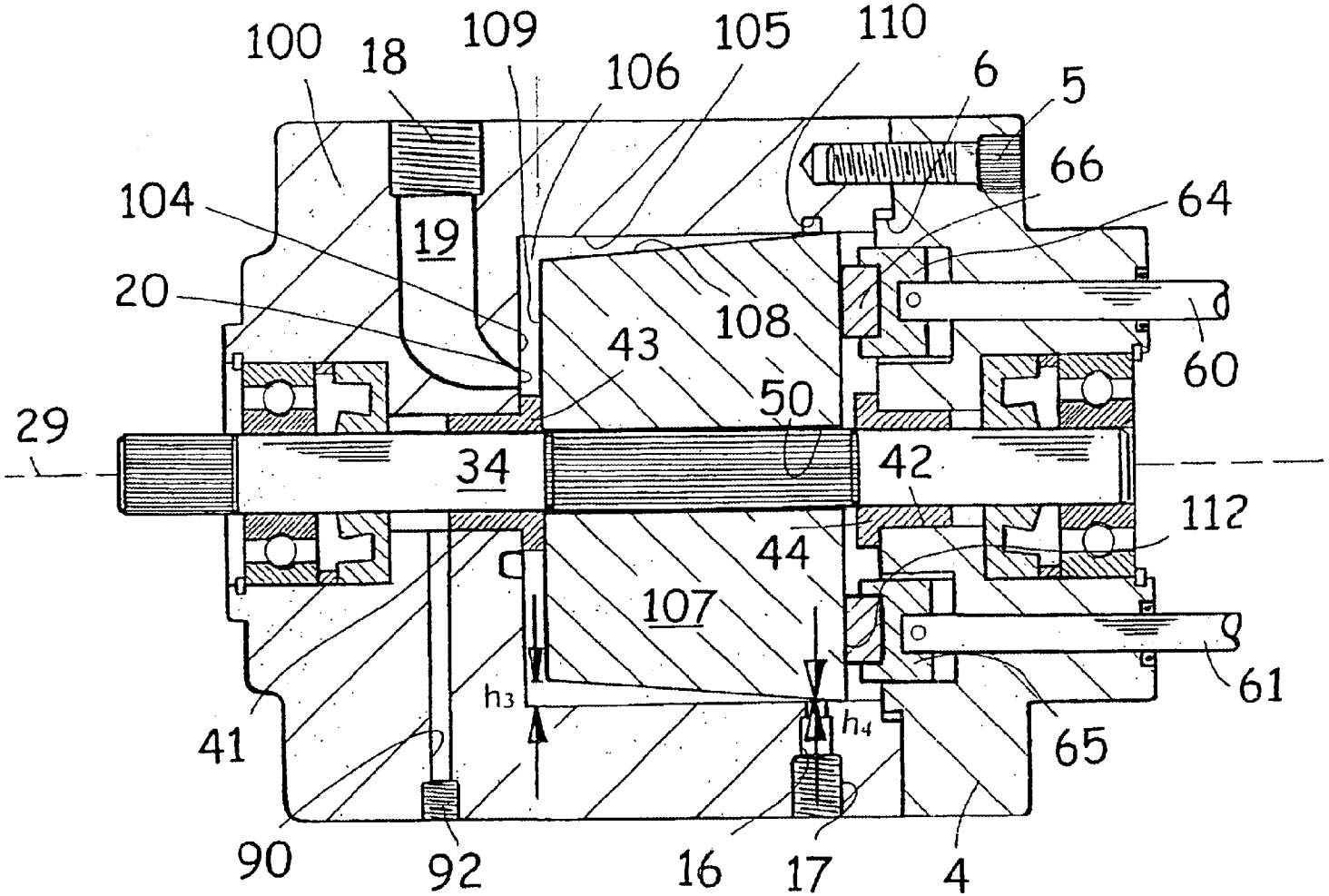
FIG. 8 is a longitudinal sectional view of a device according to the second embodiment of the present invention, with the internally disposed rotor assembly shown in the left position corresponding to a minimum value for radial clearance at the capturing groove.

The second embodiment, depicted in FIGS. 7 and 8, differs in two main respects from the above-described first embodiment. Firstly, the inner surface for the main chamber is no-longer conical but parallel, and secondly, the outer surface of the rotor assembly utilizes a less a pronounced tapering angle as compared to that selected for illustrating the first embodiment of the invention. As the other features are all very similar to the earlier embodiment, description is only necessary to show the main points of difference. Further, as many of the components are identical to those described for the first embodiment, for convenience sake, most that are here numbered also carry the same reference numeral as were used for describing the first embodiment.

As shown, housing element 100 is fastened to housing element 4 by a plurality fastening screws 5, the two housing elements 100, 4 being registered together at 6 ensuring the accurate alignment for drive shaft 34. The inner surface 105 in housing element 100 is preferably arranged to be parallel with respect to the longitudinal axis 29 of drive shaft 34. The inner surface 105 in housing element 100 is preferably arranged to be parallel with respect to the longitudinal axis 29 of drive shaft 34, and where 104 is the vertical end wall in housing element 100. The rotor assembly 107 includes a small angular taper on its outer surface 108 in order such that the gap height h1, shown in FIG. 7 for the annular clearance at the smaller diameter end 109 of the rotor assembly 107, remain always greater in magnitude than the gap height h2, shown positioned in FIG. 7 at the center of circumferential groove 110, for the larger diameter end 112 of the rotor assembly 107. The rotor assembly 107 here being positioned to the extreme right hand side to abut against flanged end 44 of sleeve 42. For FIG. 8, the rotor assembly 107 has been displaced towards its other extreme position on the left hand side, to abut flanged end 43 of sleeve 41. In this position it will be apparent that while gap height h3, for the annular clearance at the smaller diameter end 109 of the rotor assembly 107, remains unchanged (h3 being equal in magnitude to h1 in FIG. 7), whereas gap height h4 at the center of circumferential groove 110 in FIG. 8 has now significantly reduced in magnitude (as compared with h2 in FIG. 7). Consequently, liquid travelling along the annular fluid volume between h3 and h4 in FIG. 8 is throttled to a far more marked extent as compared to its travel between positions h1 and h2 in FIG. 7. As a result, the liquid travelling along the fluid heat generating region in this second embodiment of the invention is subjected to this additional throttling effect during its approach towards circumferential groove 110 as compared to the first embodiment of the present invention.

DETAILED DESCRIPTION OF THE THIRD EMBODIMENT OF THE INVENTION

As the third embodiment of the present invention is a hybrid of the first and second embodiments of the invention, as such, only those features that differ will be here now described.

Figure 9:
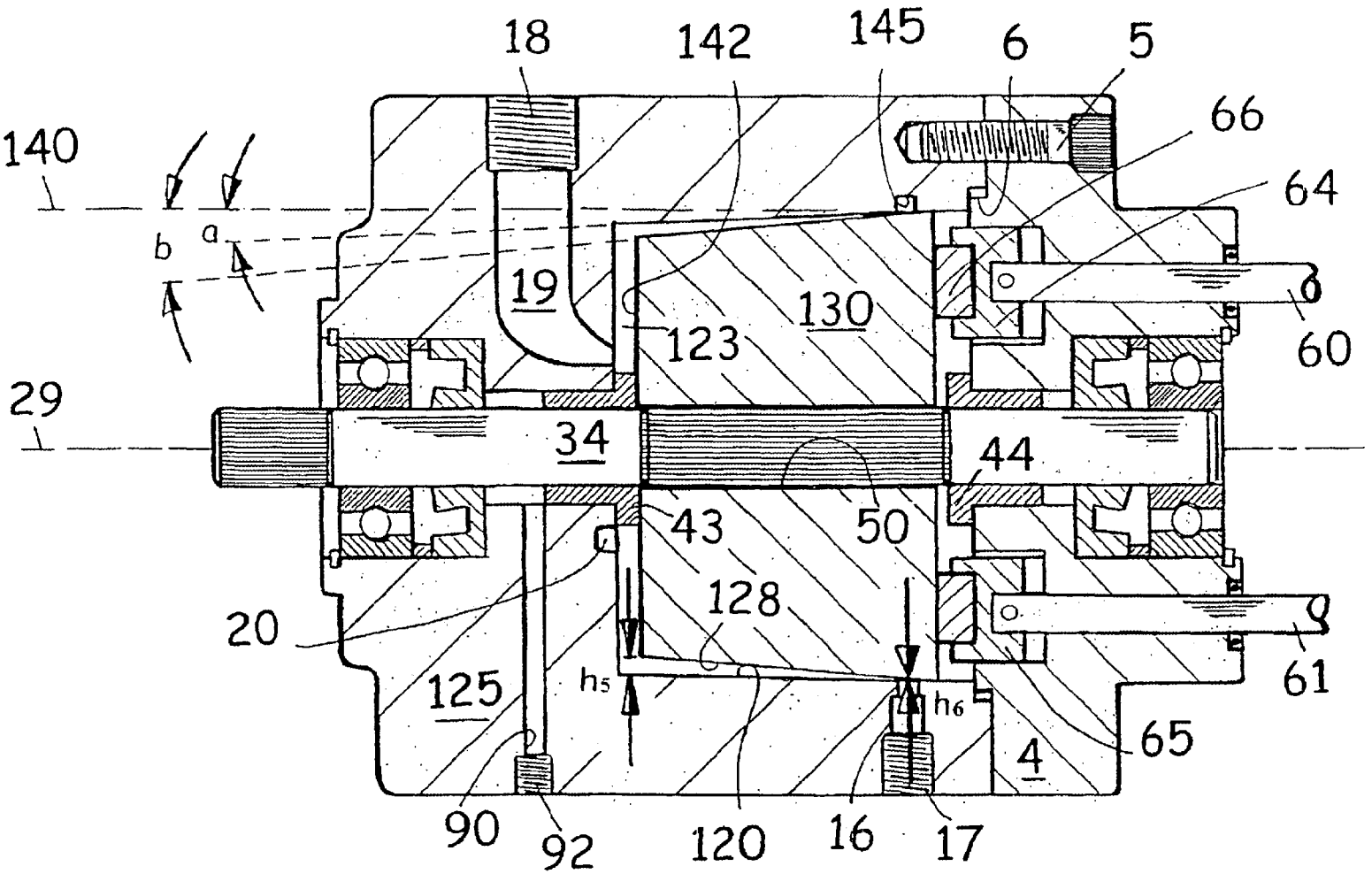
FIG. 9 is a longitudinal sectional view of a device according to the third embodiment of the present invention.

In FIG. 9, the inner surface 120 for the main chamber 123 in housing element 125 as well as outer surface 128 of the rotor assembly 130 remain conical as was the case in the first embodiment of the invention. However, here first and second boundary defining surfaces are angularly inclined with respect to the rotating axis by different amounts. Note therefore that the inner surface 120 in housing element 125 is angularly inclined by an angle depicted by "a" from the horizontal axis shown as 140 whereas the outer surface 128 of the rotor assembly 130 is angularly inclined by an angle depicted by "b" from the horizontal; axis shown as 140. Horizontal axis 140 is shown lying parallel and offset with respect to rotation axis 29 of drive shaft 34.

With this hybrid, liquid travelling along the annular fluid volume between h5, depicting the annular clearance at the smaller diameter end 142 of the rotor assembly 130, and h6, the gap height at the center of circumferential groove 145, although throttled in similar fashion as for the second embodiment described earlier, is throttled to a far more marked extent as a result of both surfaces 120, 128 being angularly inclined with respect to the horizontal.

Although the embodiments described above rely on a circumferential groove for the collection of the heated liquid or gas at the exit region, the device could be adapted to include axial end porting on the larger diameter end of the rotor assembly. Then the fluid outlet would be served by a duct positioned in the housing axially adjacent the rotor assembly.

Through the precise control in the size of the radial gap height between the fluid boundary defining surfaces of the revolving element and the static element, the device is able to respond much faster to changed conditions with far more precision and rapidity than prior solutions relying on a fixed clearance between the rotor and housing. Consequently there is far better control of the heat being generated by the device.

Although all the embodiments here described are best served by having a rotor assembly that can be bodily shifted axially along the longitudinal axis of the drive shaft either towards or away from the static inner working surface of the housing to fine tune the desired for characteristic from the device, it is not intended to limit the present invention in this way. For instance, with certain applications to which the apparatus as described may be advantageously applied, the initial radial clearance selected between rotor and housing may be satisfactory and suit all the conditions encountered in service. In such situations, it may be quite acceptable that the rotor remain fixed to the drive shaft without having any inherent ability or freedom to move relative to the drive shaft, although preferably, ability for such movement would be advisable, at least for the reason to take up slack due to wear or the bedding in of the running componentry.

Additional heating of the fluid can be created in the device once there is a notable pressure difference occurring between inlet and exit. For example, when mains pressure is used, or an internal impeller is used to create additional pressure head, heat is automatically released once the fluid emerges in the lower pressure zone. This mechanical heating may serve to improve the effectiveness of the device. With the second and third embodiments of the invention, the throttling effect on the fluid by the converging geometry of the annular clearance volume may well be used to good effect to further promote such additional heating of the fluid.

Furthermore, although there will be turbulence in the liquid passing through between the fluid boundary defining surfaces, subject to the shearing action in heating up the liquid, additional friction can be introduced by substituting the essential smooth bore boundary surfaces with roughened surfaces, for example, by shot penning the outer surface of the rotor assembly. The thus created surface irregularities should ideally not be so pronounced however, to act as contamination traps.

In order that less reliance is placed on mains water pressure or operation with an adequate head or potential of fluid above the device, the axially expanding annular clearance along the substantive length of the rotor assembly as shown in the first embodiment, together with the helical flow pattern generated by the spinning rotor surface of the rotor is used to generate a negative pressure condition helping to propel liquid through the device. Any tendency for radial motion of the liquid in the clearance due to centrifugal force generated by the rotating rotor is vectored axially by the angularly inclined surfaces in a direction up the incline, in other words from the smaller diameter end of the rotor towards the larger diameter end of the rotor. It is envisioned that by careful selection in the critical gap height for the annular clearance, a condition tending towards cavitation in the liquid, due to molecular separation of the liquid film between the surfaces, might occur without requiring the surface irregularities taught by Griggs.

Although the rotors illustrated in the above described embodiments show rotors with smooth peripheral surfaces, surface irregularities in the form of openings may also be deployed with good effect over the periphery of the rotor; somewhat in the fashion to those deployed for a parallel cylindrical rotor disclosed by Griggs, and for the purpose of exposing the passing fluid to cavitation conditions occurring in and around the general vicinity of such openings in order to produce heat at a high yield with reference to energy input. In this respect, several more embodiments of the present invention and described in detail with reference to FIGS. 10–21 disclose rotors having a plurality of surface irregularities in the form of openings, some of which being bottom-ended holes, others being inter-connected together in the interior of the rotor.

DETAILED DESCRIPTION OF THE FOURTH EMBODIMENT OF THE INVENTION

Figure 10:
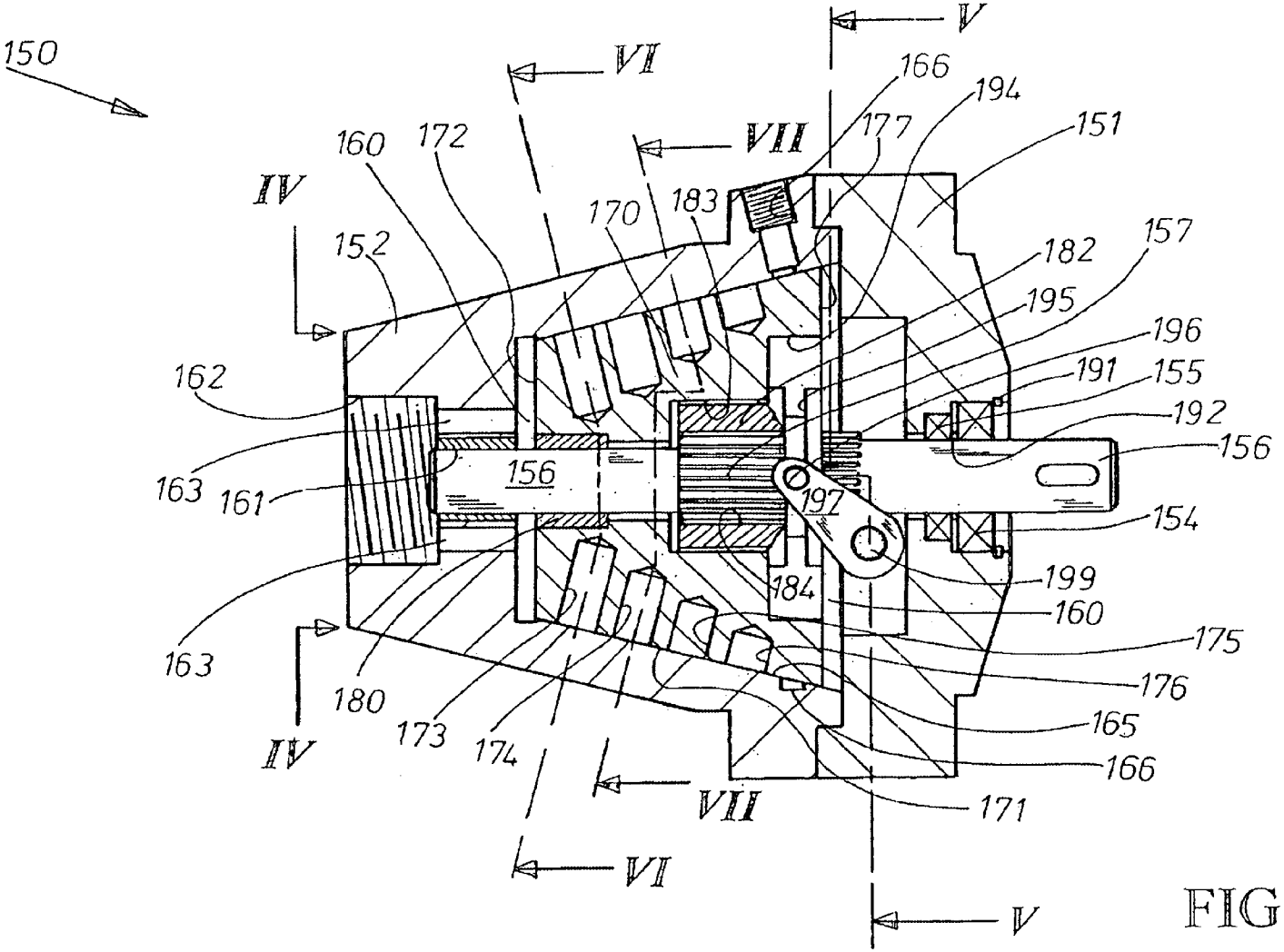
FIG. 10 is a longitudinal sectional view of a device in according to the fourth embodiment of the present invention.
Figure 11:
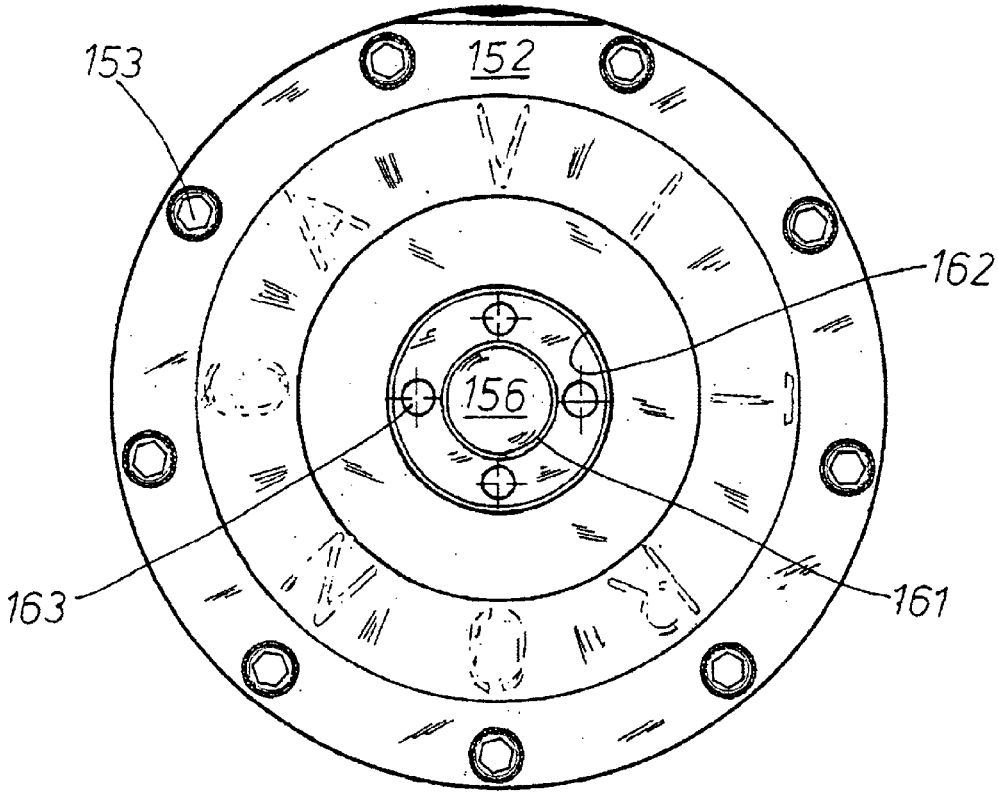
FIG. 11 is an external view of the device of the fourth embodiment of the present invention looking in the direction of arrows IV—IV in FIG. 10.
Figure 12:
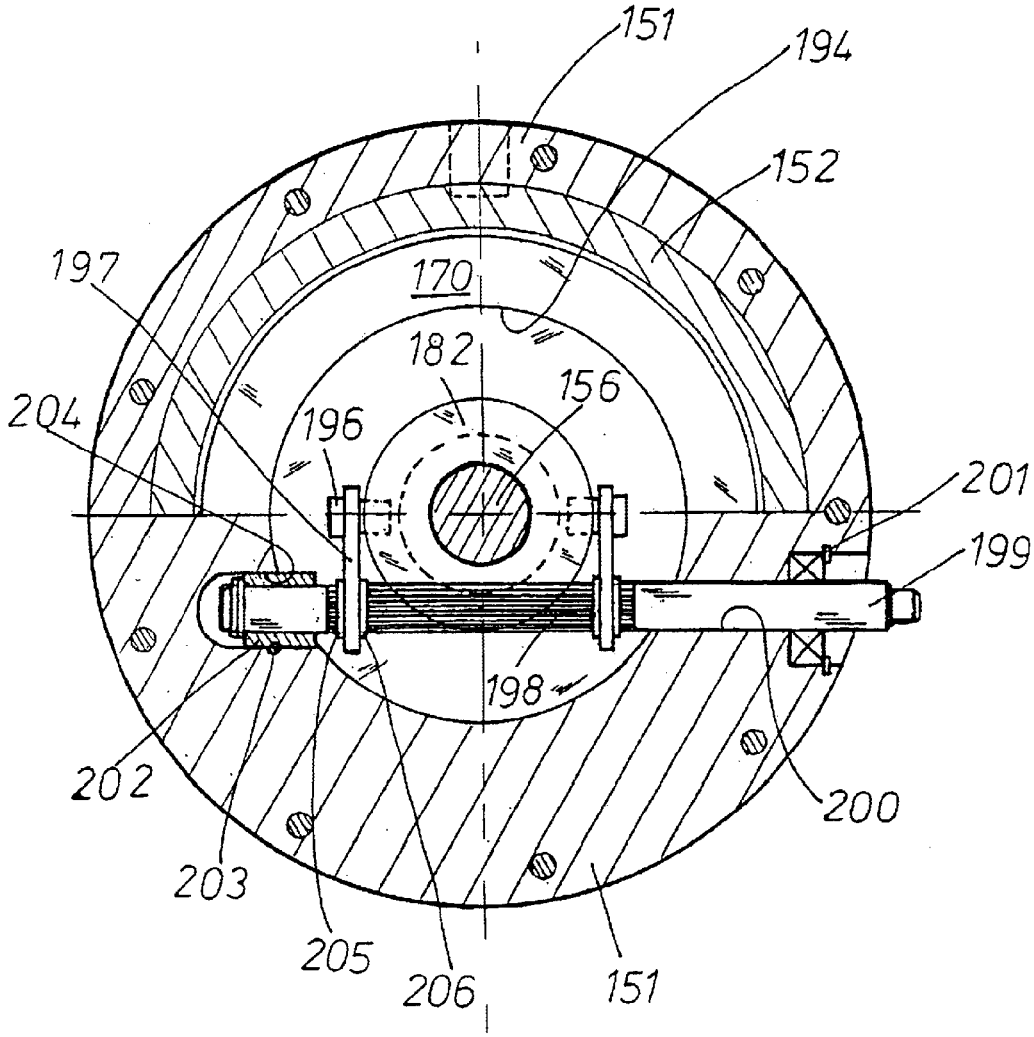
FIG. 12 is a transverse sectional view of the device taken along line V—V in FIG. 10.

Referring first to FIGS. 10 to 12, the device as designated by reference numeral 150 has a housing structure comprising two elements 151, 152 joined together by a series of socket head cap screws 153. Housing element 151 is provided with a bearing 154 and a seal 155 through which drive-shaft 156 passes through. Drive-shaft 156 is provided with a spline 157 near its mid-point and extends into the interior chamber denoted by numeral 160, of the device 150, and further supported by bearing 161 located in housing element 152. Bearing 161 lies adjacent to the fluid inlet 162 and where four ports 163 are provided, positioned radially outwardly of bearing 161, to connect fluid inlet 162 with interior chamber 160. The interior of housing element 152 includes a inner surface 165, smaller in diameter nearer to inlet ports 163 and increasingly of larger diameter in the axial direction towards housing element 151. The surface is angularly inclined with respect to the horizontal. A circumferential liquid capturing groove 166 is preferably provided on the inner surface 165 and which is fluidly connected to the fluid exit 166, also located in housing element 152. Within the interior chamber 160 is rotor unit 170, and while as shown in FIG. 10 as abutting directly against inner surface 165, is in practice residing in spaced separation.

Rotor unit 170 is provided with an outer surface 171, angularly inclined with respect to the horizontal, and where as shown, reside four rows of bottom-ended openings, openings 173, 174, 175, 176 as first, second, third, and fourth rows respectively. The number of rows may vary for the application to which the device is to be used, but typically for most applications, the number of rows should be more than one and less than twenty. Towards the center of the rotor 170, is located a support bearing 180, shown positioned nearer to the smaller-diameter end 172 of rotor 170 whereas at the opposite and larger-diameter end 177 of the rotor 170, resides drive collar 182. The drive collar 182 is threaded on its outer diameter in order that it can be screwed into position inside a female threaded pocket 183 provided in the rotor 170. Preferably, the direction of rotation of the screw thread should be counter the direction of rotation of the drive shaft 156 to ensure the rotor 170 remains fixedly connected to drive collar 182 during operation of the device. The drive collar 182 is hollow and provided with a bore 184 containing a female spline for co-operation with the male spline 157 on drive shaft 156. The drive-shaft 156 is fixed in position relative to the housing by means of respective circlips 191, 192 placed at each end of bearing 154, and the relative axial movement between the rotor 170 and drive shaft 156 can occur as the spline engagement between collar 182 and drive shaft 156 can allow such relative movement to take place as and when required.

Therefore, for devices where it is deemed advantageous to include means for altering the radial clearance existing between the rotor and housing, there must be an ability provided for the axial movement of the rotor 170 relative to housing element 152.

Unique to this fourth embodiment of the invention, there is provided towards one end of the drive collar 182 a groove 195, groove 195 lying inside the rotor 170 in sunken recess 194. Sufficient space is provided in recess 194 to allow one or more control pins 196 operate in groove 195. Pin 196 is fixed to control arm 197 and control arm 197 engages control shaft 199 by way of a spline connection 198. Control shaft 199 extends outwards from the housing element 151 so that externally applied rotation of control shaft 199 causes the control arm 197 to rotate and pin 196 to apply a force against the drive collar 182, through its engaging sliding contact with groove 195 to cause rotor 170 to be axially displaced relative to the fixed position of the drive-shaft 156. The applied force causes the rotor to move in an axial direction on the spline 157 relative to housing element 152, and as a result, the magnitude of the clearance or gap existing between the outer surface 165 in the housing element 152 and the inner surface 171 on the rotor 170, is changed. Control shaft 199 can be rotated in either direction, and as such, dependent to whether the movement is clockwise or counter-clockwise, the annular clearance is increased or decreased. Towards the outer end of control shaft 199, guidance support is provided for shaft 199 directly by bore 200 in housing element 151 and where a seal 201 prevents any escape of fluid to the environment. Towards the inner end of the control shaft 199, bearing block 202 provides support for shaft 199, and where bearing block 202 is located in groove 204 provided in housing element 151. A pin 203 locks bearing block 202 in place. The axial position of the control shaft 199 may be set by placing a respective circlip 205, 206 on each side of the control arm 197. As a result, the control shaft 199 cannot slide and slip out from the housing.

Figure 14:
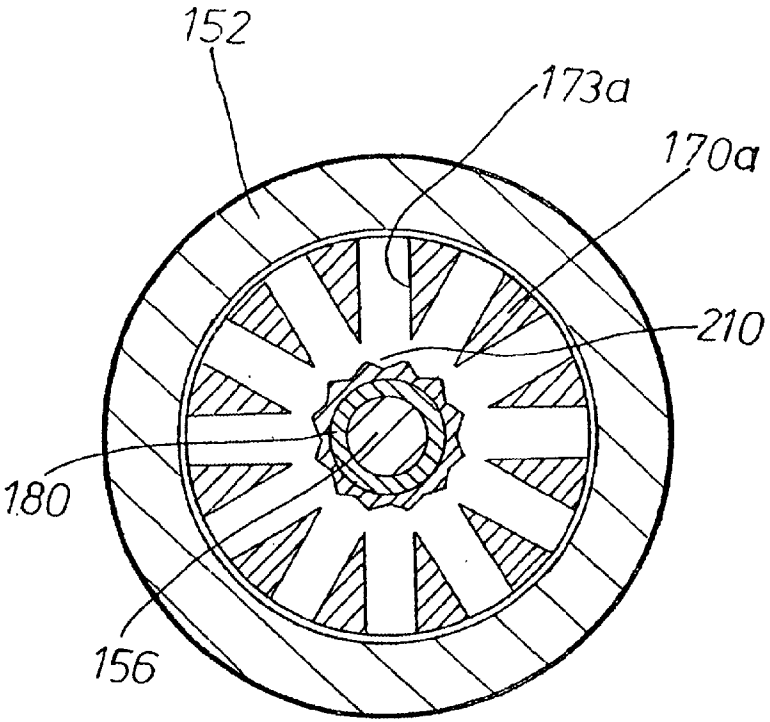
FIG. 14 depicts an alternative configuration for the row of holes in the rotor and in contrast to the holes of FIG. 13.
Figure 13:
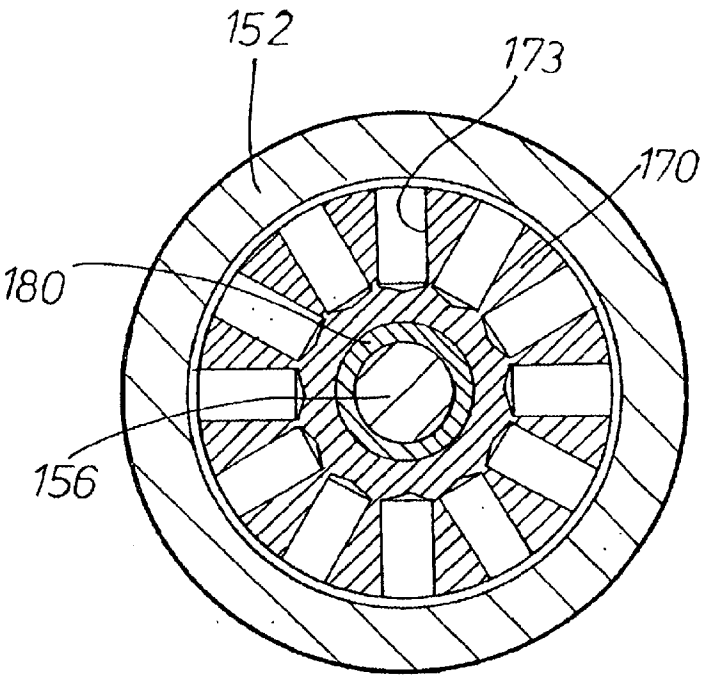
FIG. 13 is a transverse sectional view of the device taken along line VI—VI in FIG. 10 showing a cross-section through one particular row of holes in the rotor.

FIG. 13 is a section through the device 150 taken transversely and shows one complete row of bottom-ended openings, this being the first row of openings 173. There are twelve such openings 173 in this row, equi-spaced at thirty degree intervals around the circumference of the rotor 170. FIG. 14 is an alternative configuration for such openings in rotor 170*a* and where the openings 173*a* are no-longer bottom-ended as the depth set during the drilling process, has been set so when the holes are drilled, the bottoms of the holes break into each other, thereby creating what in effect is a common interior chamber denoted in FIG. 14 by the numeral 210. A common interior chamber is considered advantageous for achieving certain desired operating conditions, as well as being useful for the initial "priming" of the device.

Figure 15:
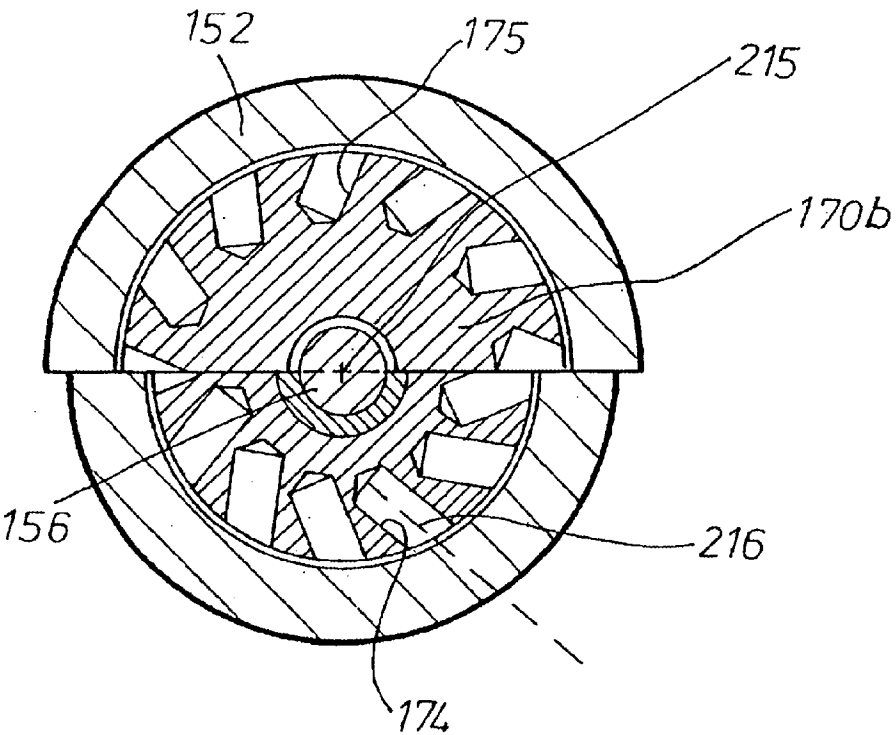
FIG. 15 is a transverse sectional view of the device taken along line VII—VII in FIG. 10 showing a cross-section through two particular rows of the holes in the rotor.

FIG. 15 is a further section through the device 150 taken transversely and here shows both second and third rows of bottom-ended holes, 174, 175, respectively. Having swept-forward or for that matter swept-backwards holes for at least some, and preferably, all of the rows of openings is though to promote an increase in the general fluid turbulence leading to a cavitational condition occurring in the device. As depicted, these openings forming the second row of holes 174 have been drilled at an angle with respect to the central axis 215 of drive shaft 156 such that the longitudinal axis 216 of the holes 174 is swept slightly forwards for a counter-clockwise orientation whereas in contrast, third row holes 175 are swept forwards for a clockwise orientation. In this example, as the first row of openings 174 is swept forwards whereas the third row of openings 175 is swept backwards, the fluid passing between the gap between the rotor 170*b* and housing element 152 is caused to be subjected to further turbulence than would be the case, if both rows of openings were orientated in a common direction. However, for certain conditions to be met, it may be sufficient for some or all the holes for the various rows of openings be swept in the same direction.

Figure 16:
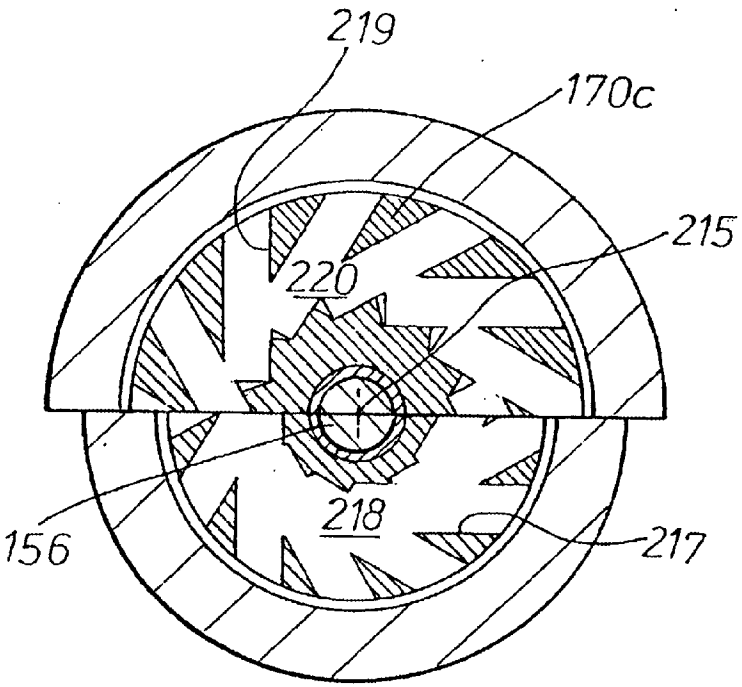
FIG. 16 depicts an alternative configuration for the rows of holes deployed in the rotor and in contrast to the holes of FIG. 15.

FIG. 16 is a further variation and where the section through the device 150 taken transversely, and like the section shown in FIG. 15, shows both the second and third rows of holes, 217, 219, respectively in rotor 170*c*. Openings in both second and third rows of holes 217, 219 are no-longer bottom-ended as was the case in FIG. 15, but have been intentionally drilled sufficiently deeply into the interior of the rotor 170*c* that they break into each other. Thus the holes 217 in the second row of openings connect with each other in the interior of the rotor 170*c* to form a common interior chamber denoted by the numeral 218, whereas holes 219 in the third row of openings connect with each other in the interior of the rotor 170*c* to form a common interior chamber denoted by the numeral 220. As depicted, all holes 217, 219 have been drilled at an angle with respect to the central axis 215 of drive shaft 156.

DETAILED DESCRIPTION OF THE FIFTH EMBODIMENT OF THE INVENTION

Figure 17:
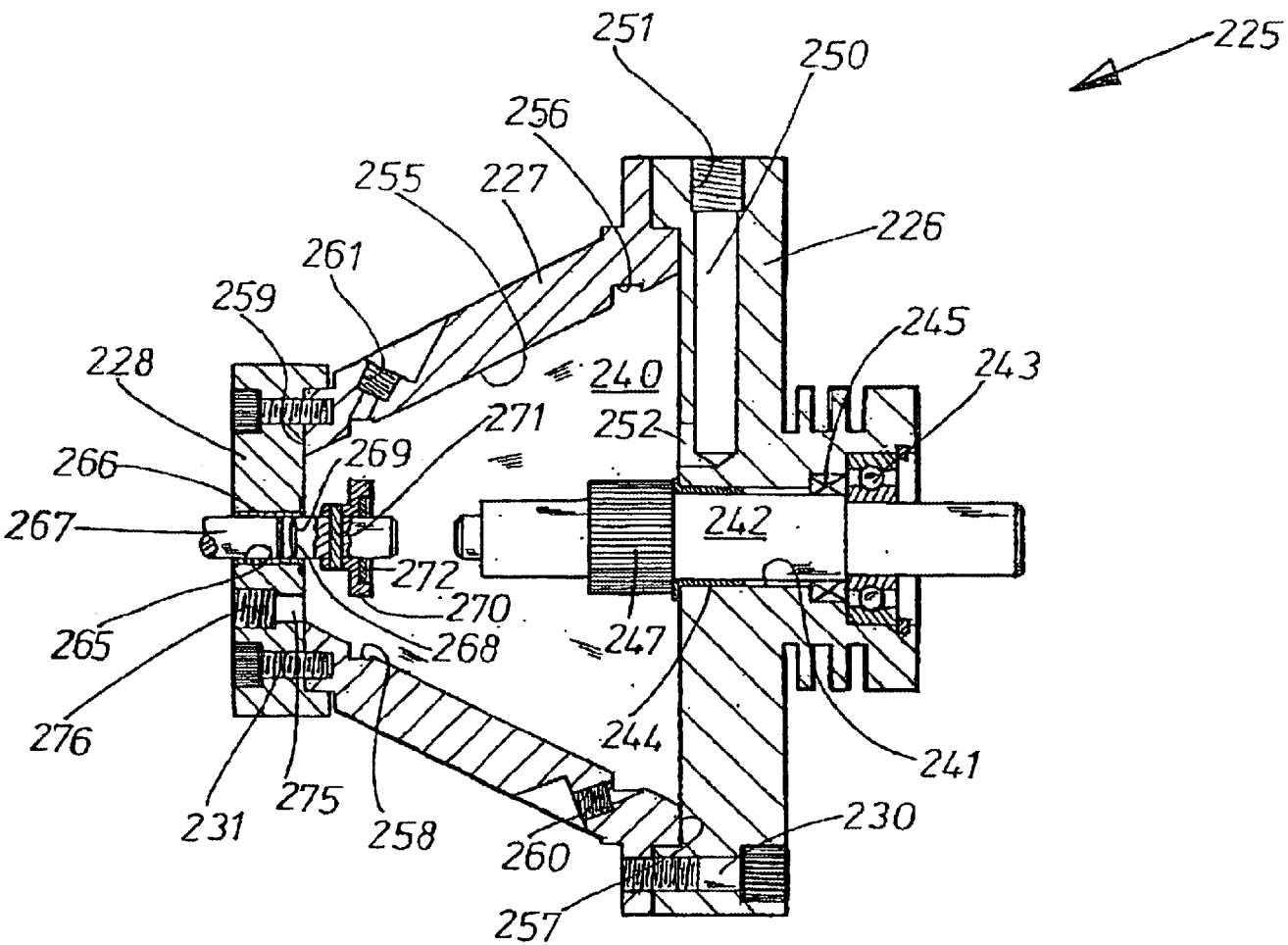
FIG. 17 is a longitudinal sectional view of a device in according to the fifth embodiment of the present invention with the rotor assembly missing.
Figure 18:
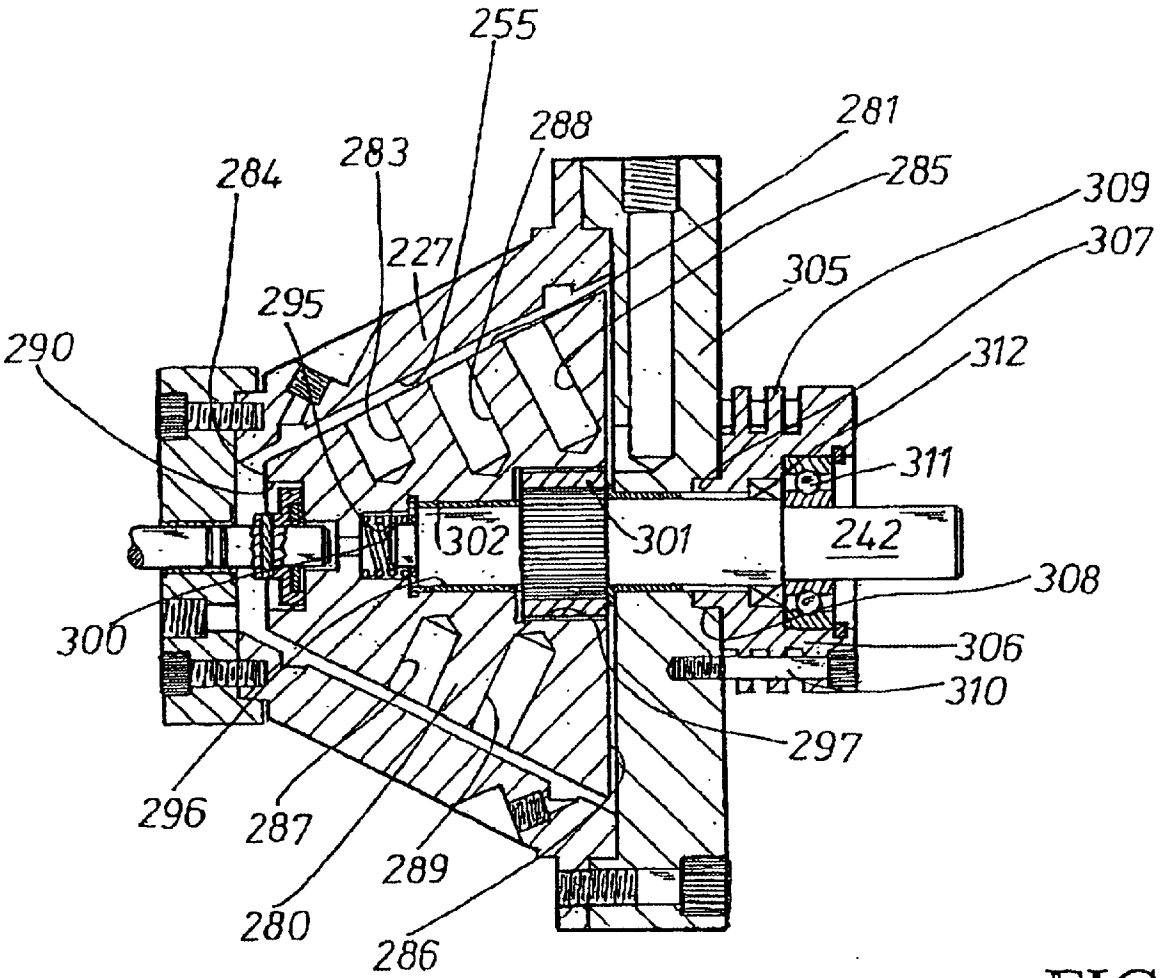
FIG. 18 is a longitudinal sectional view of a device of FIG. 17 and where the rotor assembly is included.

In the unit designated by reference numeral 225 in FIGS. 17 & 18, the housing structure comprises three main elements, front element 226, central element 227 and rear element 228. A series of screws 230 is used to hold the front 226 and central 227 housing elements together and a further series of screws 231 hold rear 228 and central 227 housings together. The housing elements 226, 227, 228 form an interior chamber 240 which for the purpose of this description, is shown in FIG. 17 without having the rotor unit deployed in this space. Front housing element 226 is provided with a central bore 241 and where drive shaft 242 passes through bore 241 and is supported by bearings 243, 244. Rotary seal 245 is employed inwards of bearing 243 and where drive shaft includes a splined portion 247 positioned adjacent bearing 244 and protruding into chamber 240. Front housing element 226 is provided with a longitudinal fluid passage 250 which connects the threaded hydraulic connection 251 with axial port 252 which opens to chamber 240.

Central housing element 227 includes an inner surface 255, increasing in diametric size in the direction towards front housing 226, the surface being therefore angularly inclined with respect to the horizontal, and where when required, a circumferential groove 256 is provided on the inner surface 255 nearer the larger end 257 of the central housing 227. A further circumferential groove 258 may be incorporated on surface 255, this groove 258 positioned nearer the smaller end 259 of central housing 227. Respective grooves 256, 258 are arranged to be in fluid communication with their respective threaded hydraulic connections 260, 261.

Rear housing element 228 includes a central bore 265 into which is a cylindrical bearing 266 is fixedly located. A control shaft 267 is a sliding fit in the bearing 266 and where control-shaft 267 is provided with one or more grooves 268 into which a sealing device such as an "O" ring seal 269 can be located. When required, such seals may include "PTFE" back-up rings to prevent any pressure in the chamber 240 from extruding the "O" ring 269 from its groove 268. Control-shaft 267 extends into chamber 240 and where control-collar 270 is attached onto shaft 267 and locked in place by pin 271. Control-collar 270 is arranged to carry a pair of thrust washers 272.

In the radial space between bore 265 and screws 231, rear housing element 228 may be provided with a axial port 275 and which serves to fluidly communicate internal chamber 240 with threaded hydraulic connection 276.

Referring now to FIG. 18 where the a rotor unit 280 is deployed in chamber 240, shown positioned in its extreme right-hand position on drive shaft 242 such that the radial gap between inner surface 255 in central housing element 227 and outer surface 281 on rotor 280 is at maximum value. Rotor 280 is provided with five rows of bottom-ended holes, starting with a first row of shortest depth holes 283 nearer to the smaller diameter end 284 of rotor 280, and ending with a fifth row of deeply drilled bottom-ended holes 285 nearer to the larger diameter end 286 of rotor 280. In-between are second, third, and fourth rows of holes depicted as holes 287, 288, 289 respectively.

At the smaller diameter end 284 of rotor 280 there is provided a recess 290 into which control-collar 270 is located, and where the outer thrust washer 272 is capable of sliding engagement with the end face of recess 290 in rotor 280. Bored from the opposite and larger diameter end 286 of rotor 280 are three recesses denoted by reference numerals 295, 296 and 297, the smaller of which 295 contains a spring 300, and the largest of which 297 is threaded to accept drive collar 301. Drive collar 301 is threaded on its outer diameter to fit the thread form provided in recess 297 and is further provided with an internal female spline which fits the drive-spline 247 provided on drive-shaft 242. Drive-collar 301 remains permanently in a fixed axial position with respect to rotor 280 whereas any required relative movement between rotor 280 and drive-shaft 242 is provided by way of the axial sliding motion on the splines 247 between drive-collar 301 and drive-shaft 242.

The middle recess 296 carries a bearing 302 for supporting the rotor 280 on drive-shaft 242.

The action of the spring 300 in recess 295 is to push the rotor 280 axially away from drive-shaft 242 thereby decreasing the radial distance between the inner and outer surfaces 281, 255 whereas the action of externally moving control-shaft 267 and control-collar 270 in a direction towards the rotor 280 is to compress spring 300 and therefore increase the radial distance between the inner and outer 281, 255 surfaces.

As shown, this embodiment of the present invention is provided with a choice of four hydraulic connections, 251, 260, 261 and 276, any of which may serve as the fluid inlet or for that matter the fluid outlet for the device 225. In most instances however, connection 276 or connection 261 is most likely to serve as the fluid inlet to the device 225 whereas connection 260 or connection 251 is not likely to serve as the fluid exit from the device 225.

The single-piece front housing element denoted by reference numeral 226 in FIG. 17 is shown as a variation in FIG. 18, and where in FIG. 18 it is comprised of two components, namely a main component denoted by reference numeral 305 and a smaller added-on additional component denoted by reference numeral 306. The additional component 306 carries a spigot 307 which fits in to a register 308 in main component 305 to provide accurate alignment between the two and where a number of socket-head cap screws 310 are used to hold the two components together. One advantage over having a single front housing component is that additional component 306 can be fabricated using a good heat dissipating material such as aluminium, and where in additional a number of cooling fins 309 can be included, especially when the component is manufactured as a pressure die-cast component. When the device operates at elevated temperatures, good thermal heat dissipating properties in the region of the bearing and seal 311, 312 is an advantage for the avoidance from premature degradation.

Although, less preferable, additional component 306 may alternatively be spot-welded in-place with main component 305 instead of using screws 310 but this depends of both components 305, 306 being fabricated of similar materials, preferably steel or aluminium.

DETAILED DESCRIPTION OF THE SIXTH EMBODIMENT

Figure 19:
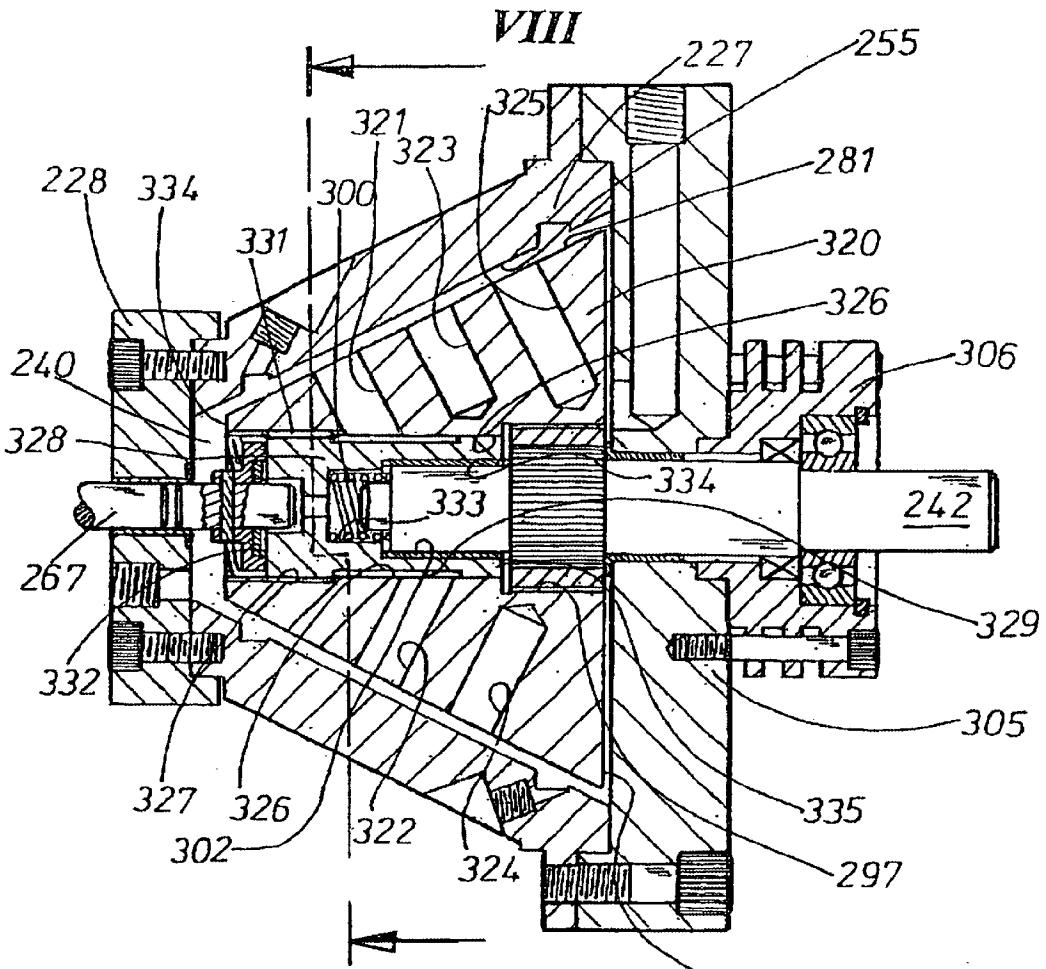
FIG. 19 is a longitudinal sectional view of a device in according to the sixth embodiment of the present invention.
Figure 20:
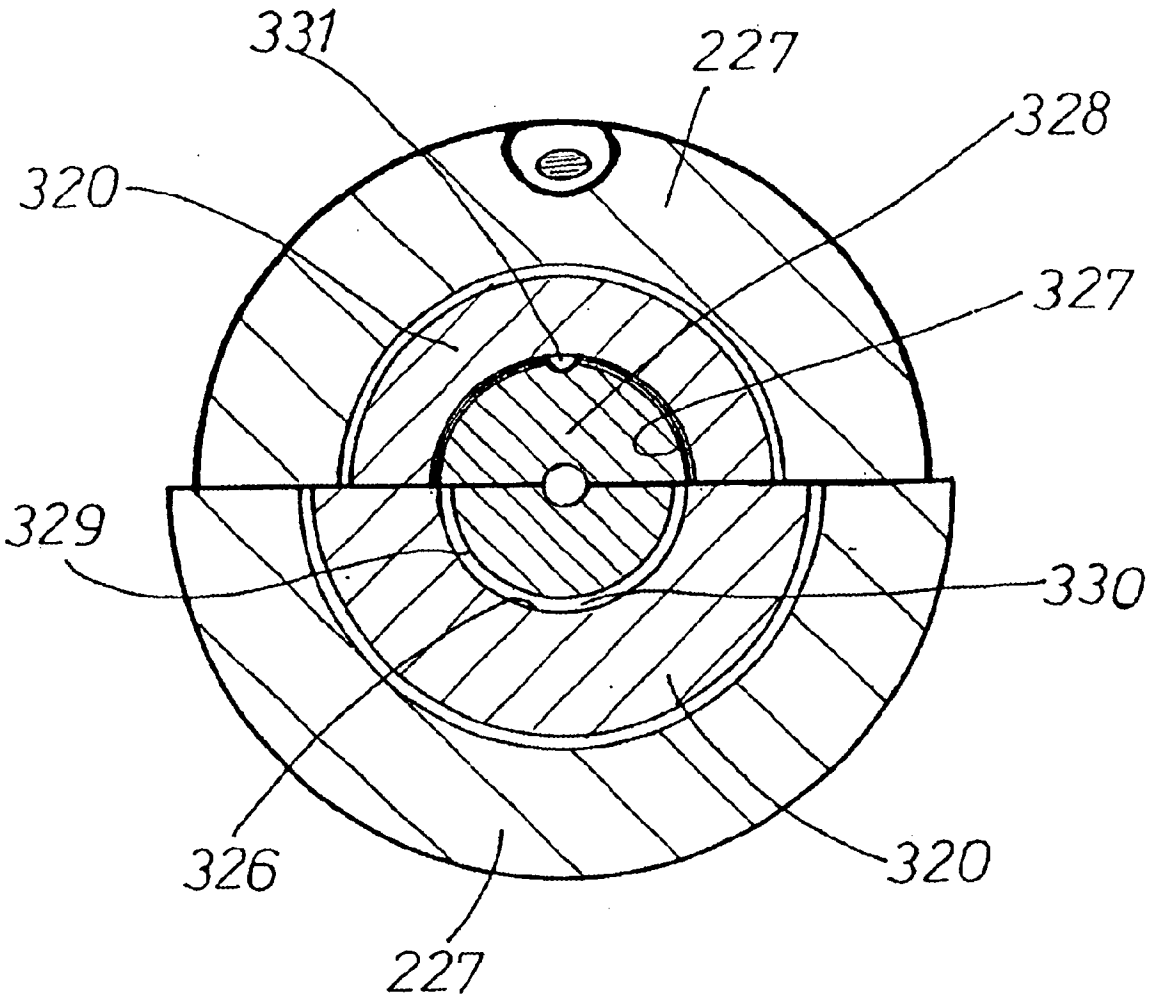
FIG. 20 is a transverse sectional view of the device taken along line VIII—VIII in FIG. 19.

As the sixth embodiment, depicted in FIGS. 19 and 20, differs in one major respect with the previously described fifth embodiment, and consequently, description is only necessary to show the main points of difference. Further, as many of the components are identical to those described for the fifth embodiment, for convenience sake, those identical components that are here numbered also carry the same reference numeral as were used for describing the fifth embodiment.

One difference lies in the interior of the rotor 320 which is now formed with a large central through bore 326 and which connects with recess 297. A portion of bore 326 nearer to the smaller diameter end 334 of rotor 320 is threaded 327 and plug member 328 is disposed in bore 326. Towards the outer headed-end 332 of plug 328, the surface carries a complimentary screw thread so that the plug 328 can be anchored tightly in bore 326. Towards the inner headed-end 335 of plug 328, this portion of the plug 328 is arranged to be a good fit in bore 326. In the spacing between the threaded portion 327 of bore 326 and the inner headed-end 335 of plug 328 there lies an under cut region 329 which forms a small annular chamber 330 between plug 328 and rotor 320. This small annular chamber 330 is arranged to fluidly communicate with main internal chamber 240, either by providing sufficient clearance on the screw thread or preferably and as here illustrated, by providing a notch 331 etched on the surface of plug 328.

The interior of plug 328 has a small diameter bore 333 to provide the space for spring 300 to reside, and a joining larger diameter bore 334 which carries bearing 302.

The rotor 320 is provided with five rows of openings, starting with the first row depicted by hole 321 nearest the smaller diameter end 334 of rotor 320 and ending with the fifth row depicted by hole 325 nearer the larger diameter end 336 of rotor 320. Second, third and fourth rows of openings are depicted by holes 322, 323, 324, respectively.

Third, fourth and fifth rows depicted by holes 323, 324, 325 are identical to those described in the fifth embodiment, but as a further difference between the two embodiments, here first and second rows of openings, depicted here as holes 321 and 322, are provided with sufficient depth to communicate with annular space 330.

The purpose of providing at least one row of holes with an inwardly located connection with internal chamber 240 is two fold. Firstly, a stationary device is easier to "prime" with fluid, the fluid entering into internal chamber 240 can flow in two directions to fill hole 321, namely by the path existing between inner and outer surfaces 281, 255, and also via notch 331 and annular chamber 330. Secondly, during operation when fluid initially residing in hole 321 is throw outwardly by centrifugal force towards expulsion from the hole 321, the consequent drop in pressure within the hole 321 acts in drawing a small quantity of fluid via notch 331 and annular space 330 into the hole 321. It is however important that the quantity of fluid able to access hole 321 via notch 331 be kept small as otherwise a short-circuit is created with the effect that both first and second row of holes 321, 322 would not then be able to generate a worthwhile drop in pressure. Therefore notch 331 really acts as a throttle and would for most instances be smaller in cross-section than is actually depicted in FIGS. 19 & 20.

It should be pointed out that although first and second rows of holes 321, 302 are drilled with sufficient depth to be in direct communication with the annular chamber 330 formed by bore 326 and undercut 329, this does not imply that less in number than two rows or more in number than two rows can be so connected to notch 331.

DETAILED DESCRIPTION OF THE SEVENTH EMBODIMENT OF THE INVENTION

Figure 21:
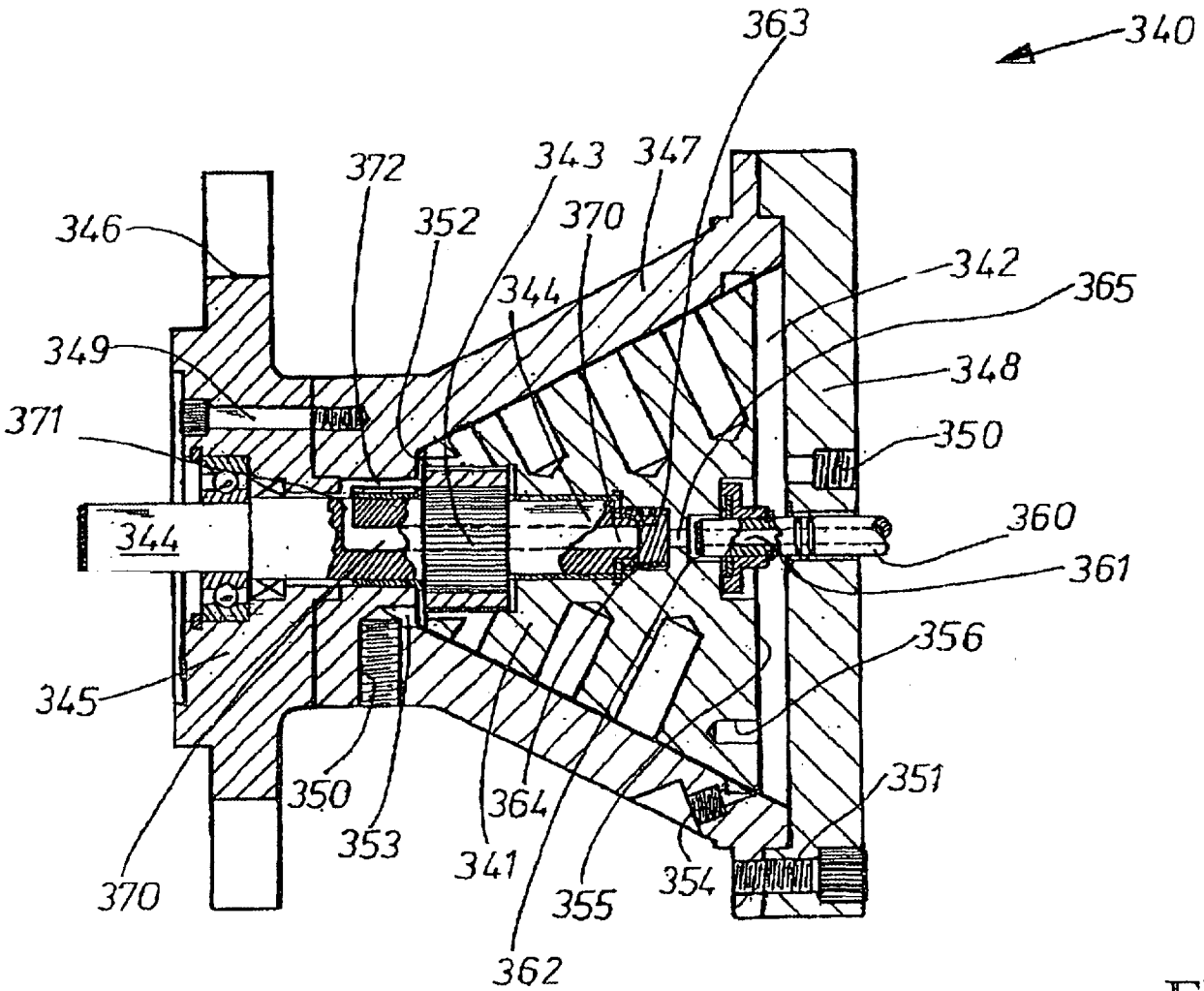
FIG. 21 is a longitudinal sectional view of a device in according to the seventh embodiment of the present invention.

In the seventh embodiment of the invention in FIG. 21, the unit designated by reference numeral 340, while being in many ways quite similar to the fifth embodiment of FIGS. 17–18, does differ in respect that both outer surface of the rotor 341 and the opposing inner surface provided by the surrounding housing 347 are angularly inclined with respect to the horizontal in a manner whereby the smaller diametric end of the rotor will now lie closer to the protruding external end of drive-shaft 344. As a result, spline 343 on drive shaft 344 is positioned closer to the smaller diameter end 352 of rotor 341 as compared to its location shown in the fifth embodiment.

The housing surrounding internal chamber 342 may comprise three housing elements, a front housing element 345 shown with SAE mounting flange 346, central housing element 347 and rear end housing element 348. Front and central housing elements are connected together by a series of screws 349 although alternatively, a single aluminium pressure die-casting could be used in place of the two components if so desired, and especially in respect for hot water applications. The rear housing elements 348, which may include drain port 350, is connected to the central housing element 347 by a series of screws 351. However, alternatively, drain port 350 may be used as the fluid exit for the device. For most applications, the fluid intake for the device 340 is threaded hydraulic connection 350 which communicates near the smaller diameter end 352 of rotor 341 by way of port 353. Also for most applications, the fluid exit is threaded hydraulic connection 354 positioned near the larger diameter end 355 of rotor 341. Hole 356 in end face 355 is for dynamically balancing the rotor 341.

Although perhaps slightly less preferable, nevertheless an alternative fluid intake that for certain applications may have merit is also shown in this particular embodiment. This alternative fluid intake may be used in-place of hydraulic connection 350 and port 353, or to complement it. Here a control shaft 360, of a similar type to those previous control shafts already incorporated in some of the earlier embodiments, has been modified to include a central longitudinal passageway 361. The passageway 361 accepts fluid from some external source, for instance, mains pressure water, and directs the water into the interior of the device 340 to the chamber denoted by reference numeral 362 in the rotor 341. The bore 363 shown containing spring 364 is in permanent fluid communication with chamber 362 via hole 365, and the drive shaft 344, here provided with longitudinal passage 370 is also arranged to be in permanent communicating with bore 363. The inner end of longitudinal passage 370 meets radial hole 371 in drive shaft 344 and where housing element 347 includes a duct 372 whose purpose is to receive fluid from radial hole 371 in drive shaft 344 and direct it towards the smaller end 352 of rotor 341.

DETAILED DESCRIPTION OF THE EIGHTH EMBODIMENT OF THE INVENTION

Figure 22:
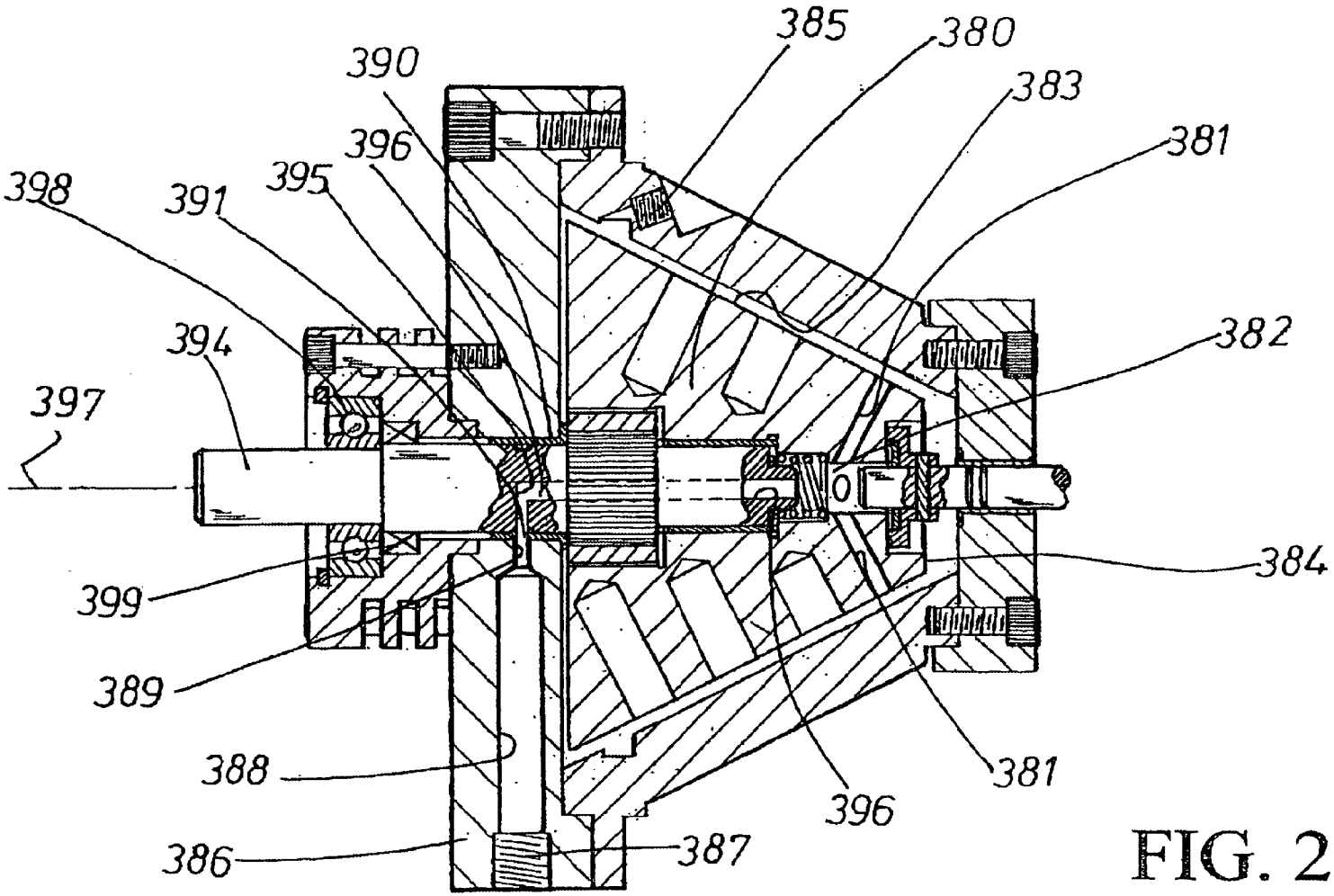
FIG. 22 is an eighth embodiment view.

The eighth embodiment of the invention in FIG. 22 is included in order to show that a device 379 may be modified in a manner whereby the interior of the rotor assembly 380 can be used in generating a fluid pumping action in place of the externally located impeller previously described for some of the earlier embodiments.

A series of generally radially disposed channels 381 are deployed within the rotor assembly 380, these channels 381 providing direct communication from chamber 382 located at the center of the rotor 380 to the outer exterior surface 383 of the rotor 380 nearer the small diameter end 384. Apart from this feature, the rotor 380 operates as described in earlier embodiments and where the fluid exits the device 379 at exit connection 385.

Housing member 386 is provided with an inlet connection 387 leading to holes 388, 389, and plain bearing 390 is provided with matching hole 391 and arranged to be in alignment with hole 389 as shown. Drive shaft 394 includes at least one radially disposed hole 395 connecting with axially disposed passage 396 lying along the rotational axis 397 of the drive shaft 394 and communicating with chamber 382. The device here illustrated is thought to be better able at operating in applications where the reservoir or fluid source is positioned at an elevation below the elevation of the longitudinal axis 397. On rotation of rotor assembly 380, channels 381 acts as centrifugal chambers to create a low pressure region in chamber 382 and fluid provided from an external source, flows into the device 379 at inlet connection 387, through holes 388, 389 in housing member 386, hole 391 in bearing 390 to reach respective holes 395, 396 in drive shaft 394 leading to chamber 382. By creating a simple pumping action by the interior fabric of the rotor, together with the impulse received by the passing fluid flowing along and across the outer surface of the rotor due to the conical geometry of the shape of the rotor, there is perhaps less reliance placed on operating the device with only mains pressure, and the bearings 390, 398 and seal 399 have increased protection due to the cooling effect on drive shaft 394 from the fluid passing through holes 395, 396.

In accordance with the patent statutes, I have described the principles of construction and operation of my invention, and while I have endeavoured to set forth the best embodiments thereof, I desire to have it understood that obvious changes may be made within the scope of the following claims without departing from the spirit of my invention.

I claim:

1. A fluid heating apparatus comprising a housing having a main chamber;

a central member within said main chamber and movable relative to said housing about an axis of rotation;

said central member comprising an outer surface confronting an inner surface of said main chamber and defining an annular fluid volume therebetween;

a fluid inlet communicating with said annular fluid volume and situated nearer one end of said main chamber and a fluid outlet communicating with said annular fluid volume and situated nearer an opposite end of said main chamber, said fluid inlet and said fluid outlet each opening exteriorly of said housing, wherein at least one of said inner and outer surfaces is angularly inclined relative to said axis of rotation, further comprising a plurality of openings circumferentially spaced about said outer surface over a majority of length of said central member for confronting fluid entering said chamber, and wherein rotation of said central member causes said plurality of openings to impart heat-generating cavitation to a fluid entering said chamber.

2. The fluid heating apparatus according to claim 1 wherein said central member is a rotor driven in rotation about said axis of rotation, and said inner surface being stationary.

3. The fluid heating apparatus according to claim 2 further comprising a drive shaft rotatably supported in said housing and having a longitudinal axis of rotation; said rotor being driven by said drive shaft and where at least one of said inner and outer surfaces can be axially displaced relative to the position of said drive shaft to alter the rate of fluid passing through said annular fluid volume.

4. The fluid heating apparatus according to claim 3 wherein said one of said first and second cylindrical surfaces is rotating at equal speed to said drive shaft.

5. The fluid heating apparatus according to claim 2 wherein both said inner and outer surfaces are inclined relative to said axis of rotation.

6. The fluid heating apparatus according to claim 2 wherein both said inner and outer surfaces are inclined relative to said axis of rotation by the same amount.

7. The fluid heating apparatus according to claim 2 wherein said inner and outer surfaces are inclined relative to said axis of rotation by a different amount.

8. The fluid heating apparatus according to claim 1, further comprising an externally controlled device for selectively positioning said central member in said main chamber wherein said inner and outer surfaces are retractable from one another in an axial direction to increase said annular fluid volume.

9. The fluid heating apparatus according to claim 1, further comprising an externally controlled device for selectively positioning said central member in said main chamber wherein said inner and outer surfaces are movable towards one another in an axial direction to decrease said annular fluid volume.

10. The fluid heating apparatus according to claim 1, further comprising an externally controlled device for selectively positioning said central member in said main chamber.

11. The fluid heating apparatus according to claim 1 wherein said plurality of openings have their respective longitudinal axes disposed perpendicular to said outer surface.

12. The fluid heating apparatus according to claim 1 wherein said plurality of openings have their respective longitudinal axes disposed perpendicular to said inner surface.

13. The fluid heating apparatus according to claim 1 wherein said plurality of openings have their respective longitudinal axes inclined in a direction towards said central member rotation.

14. The fluid heating apparatus according to claim 1 wherein said plurality of openings have their respective longitudinal axes inclined in a direction opposite said central member rotation.

15. The fluid heating apparatus according to claim 1, further comprising an interior chamber in said central member, wherein certain of said plurality of openings are arranged to fluidly connect with said interior chamber.

16. The fluid heating apparatus according to claim 15, further comprising at least one channel in said central member, said at least one channel connecting said interior chamber to one respective end face of said central member.

17. The fluid heating apparatus according to claim 1 wherein said plurality of openings are blind openings having bottoms formed within said central member.

18. The fluid heating apparatus according to claim 17 wherein said bottoms of said blind openings become disposed closer to said axis of rotation increasingly in the direction from said fluid inlet towards said fluid outlet.

19. The fluid heating apparatus according to claim 17 wherein said bottoms of said blind openings become disposed closer to said axis of rotation increasingly in the direction from said fluid outlet towards said fluid inlet.

20. The fluid heating apparatus according to claim 1 wherein a substantial number of said plurality of openings are blind openings having bottoms formed within said central member with an depth increasing in the direction from said fluid inlet to said fluid outlet or vice versa.

21. The fluid heating apparatus according to claim 1 wherein a substantial number of said plurality of openings are blind openings passing through less than half the diametric dimension of said central member.

22. The fluid heating apparatus according to claim 1 wherein a substantial number of said plurality of openings are blind openings having bottoms formed within said central member at a depth less than the radial dimension of said central member.

23. The fluid heating apparatus according to claim 1 wherein said plurality of openings comprises blind openings passing through less than half the diametric dimension of said central member.

24. The fluid heating apparatus according to claim 1 wherein said plurality of openings comprises blind openings passing through less than half the radial dimension of said central member and having bottoms formed within said central member.

25. A fluid heating apparatus comprising a housing having a main chamber and a fluid inlet and a fluid outlet in fluid communication with said main chamber, said fluid inlet and said fluid outlet each opening exteriorly of said housing;

a rotor assembly disposed centrally in said main chamber, said fluid inlet being nearer a distal end of said rotor assembly and said fluid outlet being nearer the proximate end of said rotor assembly;

a drive shaft having a longitudinal axis of rotation rotatably supported in said housing and drivingly connected to said rotor assembly for imparting mechanical energy to said rotor assembly;

and first and second opposing fluid boundary defining surfaces radially spaced apart from one another along at least a majority of length of said rotor assembly to form a fluid heat generating region and wherein at least one of said fluid boundary defining surfaces is angularly inclined with respect to said longitudinal axis, further comprising a plurality of openings disposed over whichever one of said first and second opposing fluid boundary defining surfaces is provided by said rotor assembly.

26. The fluid heating apparatus according to claim 25 wherein one of said fluid boundary defining surfaces can be axially displaced relative to the position of said drive shaft to change the volume of said fluid heat generating region and increase or decrease the through-put of fluid.

27. The fluid heating apparatus according to claim 25 wherein said first and second opposing fluid boundary defining surfaces are retractable from one another in an axial direction for an increase in the radial distance there inbetween.

28. The fluid heating apparatus according to claim 25 wherein said first and second opposing fluid boundary defining surfaces are arranged to move towards one another in an axial direction for a decrease in the radial distance there inbetween.

29. The fluid heating apparatus according to claim 25 wherein said rotor assembly can be axially displaced relative to the position of said drive shaft to change the volume of said fluid heat generating region and increase or decrease the through-put of fluid.

30. The fluid heating apparatus according to claim 25, further comprising an externally controlled device for selectively positioning said rotor assembly in said main chamber.

31. The fluid heating apparatus according to claim 30 wherein at least one of said boundary defining surfaces is rotating at equal speed to said drive shaft.

32. The fluid heating apparatus according to claim 30 wherein at least one of said boundary defining surfaces is being rotated by said drive shaft.

33. The fluid heating apparatus according to claim 32 wherein both said first and second opposing fluid boundary defining surfaces are inclined relative to said longitudinal axis.

34. The fluid heating apparatus according to claim 33 wherein both said first and second opposing fluid boundary defining surfaces are inclined relative to said longitudinal axis by the same amount.

35. The fluid heating apparatus according to claim 33 wherein said first and second opposing fluid boundary defining surfaces are inclined relative to said longitudinal axis by a different amount.

36. The fluid heating apparatus according to claim 30 wherein said rotor assembly includes an impeller disposed at the smaller of its two end faces, said impeller rotating at equal speed to said drive shaft to propel fluid radially towards said fluid heating region.

37. The fluid heating apparatus according to claim 25 wherein said rotor assembly is axially displaceable relative to said drive shaft such that on the one hand said first and second opposing fluid boundary defining surfaces may be moved closer towards one another, whereas on the other hand said first and second opposing fluid boundary defining surfaces may be moved further part from one another.

38. The fluid heating apparatus according to claim 37, further comprising an externally controlled device for selectively positioning said rotor assembly in said main chamber.

39. The fluid heating apparatus according to claim 25 wherein said openings projecting in a generally radial direction towards said axis of rotation, said openings positioned nearer the said distal end of said rotor assembly having a greater depth than those said openings positioned nearer the proximate end of said rotor assembly.

40. The fluid heating apparatus according to claim 25 wherein said openings projecting in a generally radial direction towards said axis of rotation, said openings positioned nearer the said distal end of said rotor assembly having a lesser depth than those said openings positioned nearer the proximate end of said rotor assembly.

41. A fluid heating apparatus comprising a housing;

a main chamber in said housing and a rotor assembly disposed in said main chamber, said rotor assembly and said main chamber defining an inlet region, an exhaust region and a fluid heat generating region;

a drive shaft having a longitudinal axis of rotation rotatably supported in said housing and drivingly connected to said rotor assembly for imparting mechanical energy to said rotor assembly;

a fluid inlet provided in said housing and in fluid communication with said inlet region;

a fluid outlet provided in said housing and in fluid communication with said exhaust region;

said fluid inlet and said fluid outlet each opening exteriorly of said housing, said apparatus further comprising first and second opposing fluid boundary defining surfaces radially spaced apart from one another along at least a majority of length of said rotor assembly to form said fluid heat generating region and a unidirectional pathway for fluid upon entering said inlet region to reach said exhaust region, wherein at least one of said fluid boundary defining surfaces is angularly inclined with respect to said longitudinal axis, further comprising a plurality of openings disposed over whichever one of said first and second opposing fluid boundary defining surfaces is provided by said rotor assembly.

42. The fluid heating apparatus according to claim 41 wherein one of said fluid boundary defining surfaces can be axially displaced relative to the position of said drive shaft to change the volume of said fluid heat generating region and increase or decrease the through-put of fluid.

43. The fluid heating apparatus according to claim 41 wherein said first and second opposing fluid boundary defining surfaces are retractable from one another in an axial direction for an increase in the radial distance there inbetween.

44. The fluid heating apparatus according to claim 41 wherein said first and second opposing fluid boundary defining surfaces are moveable towards one another in an axial direction for a decrease in the radial distance there inbetween.

45. The fluid heating apparatus according to claim 41 wherein said rotor assembly can be axially displaced relative to the position of said drive shaft to change the volume of said fluid heat generating region and increase or decrease the through-put of fluid.

46. The fluid heating apparatus according to claim 41, further comprising an externally controlled device for selectively positioning said central member in said main chamber.

47. The fluid heating apparatus according to claim 46 wherein at least one of said boundary defining surfaces is rotating at equal speed to said drive shaft.

48. The fluid heating apparatus according to claim 46 wherein at least one of said boundary defining surfaces is being rotated by said drive shaft.

49. The fluid heating apparatus according to claim 48 wherein both said first and second opposing fluid boundary defining surfaces are inclined relative to said longitudinal axis.

50. The fluid heating apparatus according to claim 49 wherein both said first and second opposing fluid boundary defining surfaces are inclined relative to said longitudinal axis by the same amount.

51. The fluid heating apparatus according to claim 49 wherein said first and second opposing fluid boundary defining surfaces are inclined relative to said longitudinal axis by a different amount.

52. The fluid heating apparatus according to claim 46 wherein said housing includes a port and where said inlet is connected by said port to said fluid entry region.

53. The fluid heating apparatus according to claim 52 wherein said housing includes a fluid capturing groove, said capturing groove circumferentially surrounding said fluid heat generating region and positioned nearer that distal end of said rotor assembly lying furtherest from said inlet region, said exhaust region connected by said fluid capturing groove to said fluid exit.

54. The fluid heating apparatus according to claim 46 wherein said inlet region increases in volume as said rotor assembly is axially displaced in the direction for causing said first and second opposing fluid boundary defining surfaces to move further part from one another.

55. The fluid heating apparatus according to claim 54 wherein said rotor assembly includes an impeller disposed at the smaller of its two end faces, said impeller rotating at equal speed to said drive shaft in said inlet region to propel fluid radially towards said fluid heat generating region.

56. The fluid heating apparatus according to claim 55 wherein said plurality of openings are disposed in at least two circumferential rows, each respective opening having a entrance and where the entrances to those said openings disposed in one of said at least two circumferential rows lies radially closer to said rotational axis than the entrances to those said openings disposed in any other of said at least two circumferential rows.

57. A fluid heating apparatus according to claim 41 wherein said rotor assembly is axially displaceable relative to said drive shaft such that on the one hand said first and second opposing fluid boundary defining surfaces may be moved closer towards one another, whereas on the other hand said first and second opposing fluid boundary defining surfaces may be moved further part from one another.

58. The fluid heating apparatus according to claim 57, further comprising an externally controlled device for selectively positioning said central member in said main chamber.

59. A fluid heating apparatus comprising:

a housing having a main chamber;

a rotor within said main chamber and movable relative to said housing about an axis of rotation, said rotor having an outer surface confronting an inner surface of said main chamber and defining an annular fluid volume therebetween; and a fluid inlet communicating with said annular fluid volume and situated nearer one end of said main chamber and a fluid outlet communicating with said annular fluid volume and situated nearer an opposite end of said main chamber, wherein at least one of said inner and outer surfaces is angularly inclined relative to said axis of rotation, further comprising a plurality of openings circumferentially spaced about said outer surface in at least two rows of openings over a majority of length of said rotor for confronting fluid entering said chamber, and wherein the total volumetric capacity carried by one row of said at least two rows of openings disposed nearer the larger diameter end of said rotor differs from the total volumetric capacity carried by the other row of said at least two rows of openings disposed nearer the smaller end of said rotor.

60. The fluid heating apparatus according to claim 59 wherein the total volumetric capacity carried by one row of said at least two rows of openings disposed nearer the larger diameter end of said rotor is greater than the total volumetric capacity carried by the other row of said at least two rows of openings disposed nearer the smaller end of said rotor.

61. The fluid heating apparatus according to claim 59 wherein the total volumetric capacity carried by one row of said at least two rows of openings disposed nearer the larger diameter end of said rotor is less than the total volumetric capacity carried by the other row of said at least two rows of openings disposed nearer the smaller end of said rotor.

62. The fluid heating apparatus according to claim 59 wherein the apparent depth of said one row of said at least two rows of openings occupies a lesser radial distance towards said axis of rotation than the apparent depth of said other row of said at least two rows of openings.

63. The fluid heating apparatus according to claim 59 wherein the apparent depth of said one row of said at least two rows of openings occupies a greater radial distance towards said axis of rotation than the apparent depth of said other row of said at least two rows of openings.

64. The fluid heating apparatus according to claim 59 wherein the rotation of said central member causes said plurality of openings to impart heat-generating cavitation to a fluid entering said chamber.

65. The fluid heating apparatus according to claim 59, further comprising an externally controlled device for selectively positioning said rotor in said main chamber.

* * * * *